US012262828B2

(12) United States Patent
Xu

(10) Patent No.: US 12,262,828 B2
(45) Date of Patent: Apr. 1, 2025

(54) SHOE COVER DISPENSER DEVICE

(71) Applicant: OTO Industry (Wuhan) Co., Ltd., HanChuan (CN)

(72) Inventor: Liang Jie Xu, HanChuan (CN)

(73) Assignee: OTO Industry (Wuhan) Co., Ltd., HuBei (CN)

( * ) Notice: Subject to any disclaimer, the term of this patent is extended or adjusted under 35 U.S.C. 154(b) by 0 days.

(21) Appl. No.: 18/387,457

(22) Filed: Nov. 6, 2023

(65) Prior Publication Data

US 2024/0065464 A1 Feb. 29, 2024

Related U.S. Application Data

(62) Division of application No. 17/844,678, filed on Jun. 20, 2022, now Pat. No. 11,992,139, which is a division of application No. 17/489,784, filed on Sep. 30, 2021, now Pat. No. 11,478,098.

(51) Int. Cl.

| | |
|---|---|
| ***A47G 25/90*** | (2006.01) |
| ***A43B 3/10*** | (2006.01) |
| ***A43B 3/16*** | (2022.01) |
| ***B65D 73/00*** | (2006.01) |
| ***B65D 83/08*** | (2006.01) |

(52) U.S. Cl.

CPC ..... *A47G 25/90* (2013.01); *A43B 3/106* (2013.01); *A43B 3/163* (2013.01); *B65D 73/00* (2013.01); *B65D 83/08* (2013.01); *B65D 83/0894* (2013.01)

(58) Field of Classification Search

CPC ..... B65H 1/00; B65H 2405/50; B65H 2701/1212; B65D 83/0894; B65D 73/00; B65D 83/08; A43B 3/163; A43D 999/00; A43D 2200/30

USPC ..... 223/113; 12/1 R; 221/191, 171, 232, 221/111, 112

See application file for complete search history.

(56) References Cited

U.S. PATENT DOCUMENTS

| | | | | |
|---|---|---|---|---|
| 3,775,793 A * | 12/1973 | Casavant | A43D 11/003 | 12/1 R |
| 6,219,938 B1 * | 4/2001 | Anderson | A43B 3/163 | 36/7.1 R |
| 6,339,888 B1 * | 1/2002 | Brunson | A43B 3/163 | 36/7.1 R |
| 6,666,479 B1 * | 12/2003 | Maddaleni | A63C 3/12 | 280/825 |
| 7,108,154 B1 * | 9/2006 | Thompson | A43B 3/163 | 221/56 |

(Continued)

FOREIGN PATENT DOCUMENTS

| | | | |
|---|---|---|---|
| GB | 2299563 A * | 10/1996 | A45B 25/24 |
| KR | 101482862 B1 * | 7/2013 | B65B 67/1227 |

(Continued)

*Primary Examiner* — Rakesh Kumar

(74) *Attorney, Agent, or Firm* — David & Raymond Patent Firm; Raymond Y Chan

(57) ABSTRACT

A shoe cover dispenser device for installing a plurality of shoe covers includes a frame, an installation assembly installed on the frame, and the locking assembly installed on the frame and is capable of locking the installation assembly, so that the installation assembly can facilitate the installation of the shoe covers on or the removal of the shoe covers from the installation assembly.

12 Claims, 32 Drawing Sheets

(56) References Cited

U.S. PATENT DOCUMENTS 7,440,816 B1 * 10/2008 He ..... A43B 3/16 223/111
7,634,862 B2 * 12/2009 Cockman ..... A47G 25/905 36/138
7,669,351 B1 * 3/2010 Ghotbi ..... A43B 3/163 36/7.1 R
2002/0020031 A1 * 2/2002 Gultekin ..... A47G 25/80 12/142 R
2006/0144879 A1 * 7/2006 Hu ..... A43B 3/163 223/111
2007/0163912 A1 * 7/2007 Chen ..... B65B 67/1266 221/312 A
2007/0204568 A1 * 9/2007 Chen ..... A47G 25/80 53/473
2008/0000035 A1 * 1/2008 Levine ..... A43B 3/16 12/1 R
2008/0237277 A1 * 10/2008 Xu ..... A43D 999/00 222/526
2009/0071989 A1 * 3/2009 He ..... A43D 999/00 223/111
2009/0152312 A1 * 6/2009 Li ..... A47G 25/80 223/111
2010/0065592 A1 * 3/2010 Fard ..... A43B 3/163 223/113
2010/0288800 A1 * 11/2010 Xu ..... A43B 3/106 221/36
2011/0272440 A1 * 11/2011 Heller ..... A47G 25/907 223/113
2012/0286471 A1 * 11/2012 Grauzer ..... A63F 1/12 273/148 A
2017/0088339 A1 * 3/2017 Xu ..... A43B 3/163
2018/0317686 A1 * 11/2018 Howard ..... A61B 42/50
2024/0065464 A1 * 2/2024 Xu ..... B65D 83/08

FOREIGN PATENT DOCUMENTS

KR 200467816 Y1 * 7/2013 ..... B65B 67/1255
WO WO-9414661 A1 * 7/1994 ..... A45B 25/24

* cited by examiner

SHOE COVER DISPENSER DEVICE

CROSS REFERENCE OF RELATED APPLICATION

This application is a Divisional application that claims the benefit of priority under 35 U.S.C. § 120 to a non-provisional application, application Ser. No. 17/844,678, filed Jun. 20, 2022, which is a divisional application that claims the benefit of priority under 35 U.S.C. § 120 to a non-provisional application, application Ser. No. 17/489,784, filed Sep. 30, 2021, which is a non-provisional application that claims the benefit of priority under 35 U.S.C. § 119 to a Chinese application, application number CN202110003068.5, filed Jan. 20, 2021, which are incorporated herewith by reference in their entireties.

BACKGROUND OF THE PRESENT INVENTION

Field of Invention

The present invention relates to a shoe cover machine, and more particularly to an arrangement for holding shoe covers and a shoe cover dispenser device that is convenient for people to wear the shoe covers.

Description of Related Arts

With the development of the economy and the improvement of people's living standards, people's requirements for the environment are getting higher and higher. A clean home environment or a clean external environment will help to improve comfortness and happiness in life.

In addition, especially with the development of science and technology, the manufacturing of some products must be completed in a dust-free workshop. Therefore, people must wear dust-free clothing and clean disposable shoe covers before entering the dust-free workshop to avoid any pollution to the dust-free workshop.

Therefore, the demand for shoe cover assembly and shoe cover dispenser devices has arisen at the historic moment. Shoe cover assembly and shoe cover dispenser device are widely used in furniture, factories, model houses, hospitals, dust-free workshops and other places that require environmental cleanliness. At present, there are many styles of existing shoe cover dispensers, but most of the structural designs are not reasonable enough. When installing shoe covers, some shoe cover dispensers are complicated in process and difficult in operation, or require certain special technology to be able to install shoe covers on the shoe cover dispenser, which is inconvenient for people to fill or replace the shoe covers on the shoe cover dispenser at any time. During the wearing of some shoe covers, user needs to manually pull the shoe covers out, which is inconvenient for wearing the shoe covers.

SUMMARY OF THE PRESENT INVENTION

The invention is advantageous in that it provides a shoe cover dispenser device for holding multiple pairs of shoe covers in an orderly manner, thereby facilitating the integration storage of multiple pairs of shoe covers.

Another advantage of the invention is to provide a shoe cover dispenser device that enables the multiple pairs of shoe covers to be adjacently connected to each other, so as to ensure that after one shoe cover is dispensed, an adjacent shoe cover is driven to be pulled to enlarge its opening, so there is no need to separately open the subsequent shoe cover. In other words, the shoe cover dispenser device can automatically open the shoe cover in turn, thereby facilitating wearing the shoe covers.

Another advantage of the invention is to provide a shoe cover dispenser device that is convenient to install a plurality of the shoe covers thereon, so as to reduce the difficulty of installing shoe covers.

Another advantage of the invention is to provide a shoe cover dispenser device which installs and opens the shoe cover through different locking assemblies cooperated with each other. The locking mode can be achieved by different locking assemblies, so the shoe cover dispenser device of the present invention can have a variety of different fitting and deformation modes.

Another advantage of the invention is to provide a shoe cover dispenser device which can ensure that after one shoe cover is taken out, the subsequent shoe cover will not retract due to elastic contraction force.

Additional advantages and features of the invention will become apparent from the description which follows and may be realized by means of the instrumentalities and combinations particular point out in the appended claims.

According to the present invention, the foregoing and other objects and advantages are attained by a shoe cover dispenser device comprising a frame, an installation assembly installed on the frame, wherein the installation assembly comprises two installation arms for installing the plurality of shoe cover; and a locking assembly installed on the frame and is capable of locking said two installation arms of said installation assembly.

The locking assembly comprises a first locking member and a second locking member, wherein each of the two installation arms comprises a first end portion and a second end portion, wherein the first locking member is arranged to detachably lock the first end portion of each of the two installation arms, and the second locking member is arranged to detachably lock the second end portion of each of the two installation arms.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
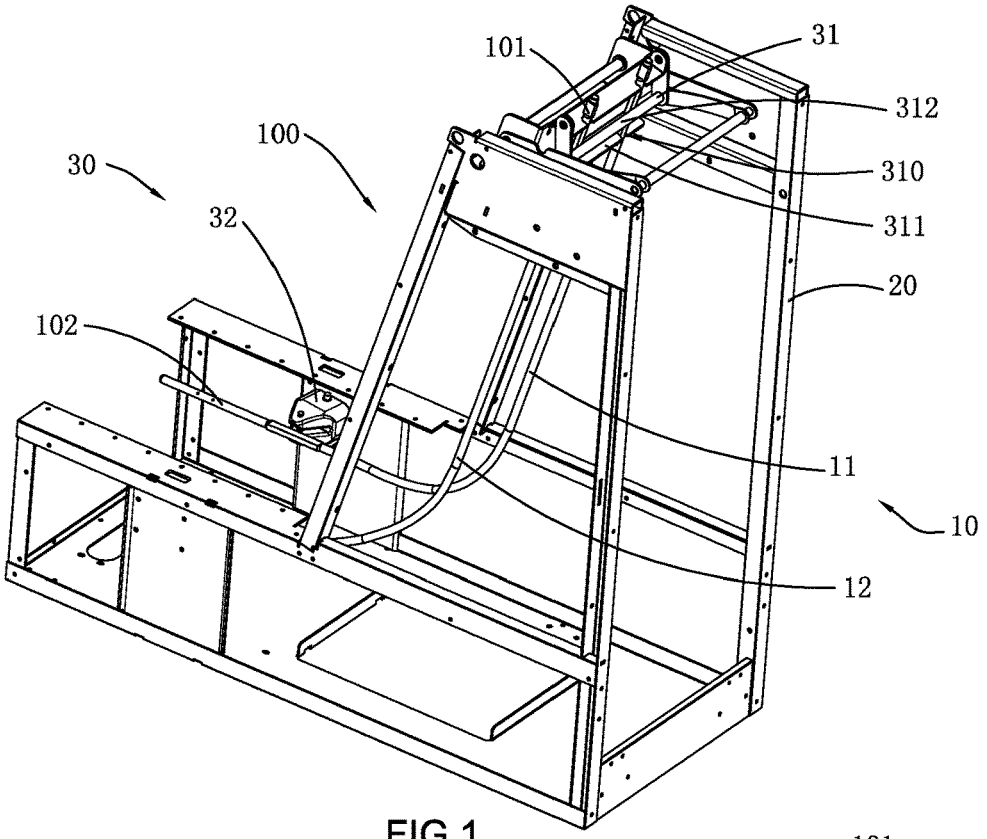
FIG. 1 is a perspective view of a shoe cover dispenser device according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

As shown in FIGS. 1 to 4, a shoe cover dispenser device 100 for dispensing a plurality of shoe covers 90 according to a first preferred embodiment of the present invention is illustrated. The shoe cover dispenser device 100 comprises an installation assembly 10, a frame 20, and a locking assembly 30. The installation assembly 10 is installed in the frame 20, and the locking assembly 30 is installed in the frame 20 and can lock the installation assembly 10.

In detail, as shown in FIGS. 1 to 4, the frame 20 is a structure capable of receiving a plurality of shoe covers 90, and the frame 20 is convenient for enabling the shoe covers 90 to be worn by a user. The installation assembly 10 comprises two installation arms 11 and 12, and the two installation arms 11 and 12 can connect a plurality of the shoe covers 90 in series and open the shoe covers 90, and can facilitate a user to wear the shoe covers 90 on shoes.

The locking assembly 30 comprises a first locking member 31 and a second locking member 32, wherein the installation assembly 10 comprises a first end portion 101 and a second end portion 102, wherein the first end portions 101 of the two installation arms 11 and 12 are locked by the first locking member 31 so that the second end portions 102 of the two installation arms 11 and 12 can be free end portions, so that the shoe cover 90 can be removed from the second end portions 102 of the installation assembly 10.

Correspondingly, the second locking member 32 can lock the second end portions 102 of the two installation arms 11 and 12, so that the installation assembly 10 is fixed to the frame 20 and the first end portion 101 of the two installation arms 11 and 12 can be free end portions which are convenient to install the shoe covers 90 on the installation assembly 10.

In other words, when installing the shoe covers 90, firstly, the second locking member 32 of the locking assembly 30 locks the second end portions 102 of the installation assembly 10, and the first locking member 31 is operated to release the first end portions 101, so that the installation assembly 10 is fixed to the frame 20 and the first end portions 101 of the installation assembly 10 are free end portions, thereby facilitating to install the shoe covers 90 on the installation assembly 10. After the shoe covers 90 are installed in the installation assembly 10, the first end portions 101 of the installation assembly 10 are locked by the first locking member 31 of the locking assembly 30, and then the second locking member 32 is opened, so that the second end portions 102 of the installation assembly 10 are released from the second locking member 32 to form free end portions, thereby facilitating the separation of the shoe covers 90 from the second end portions 102 of the installation assembly 10.

In the preferred embodiment of the present invention, the installation assembly 10 comprises two elongated installation arms 11 and 12, so as to connect a plurality of shoe covers 90 in series, and the distance between the two installation arms 11 and 12 is greater than the width of the shoe. In this way, the opened opening of each of the shoe covers 90 can facilitate the user's shoes to wear the shoe covers 90.

The first locking member 31 comprises a holding base 311 mounted to the frame 20, and a movable frame 316, wherein the holding base 311 has two grooves 310, wherein the positions of the two grooves 310 are corresponding to the positions of the first end portions 101 of the two installation arms 11 and 12 of the installation assembly 10, and the first end portions 101 of the two installation arms 11 and 12 can be respectively clamped into the two grooves 310. The first locking member 31 further comprises at least one positioning member 312 connected to the movable frame 316, the positioning member 312 can be rotated and bias against to one side of the two installation arms 11 and 12 of the installation assembly 10, so that the two installation arms 11 and 12 are respectively fixed in the two grooves 310 of the first locking member 31, thereby completing the fixing of the first end portions 101 of the two installation arms 11 and 12 of the installation assembly 10, as shown in FIG. 1 of the drawings.

Figure 2:
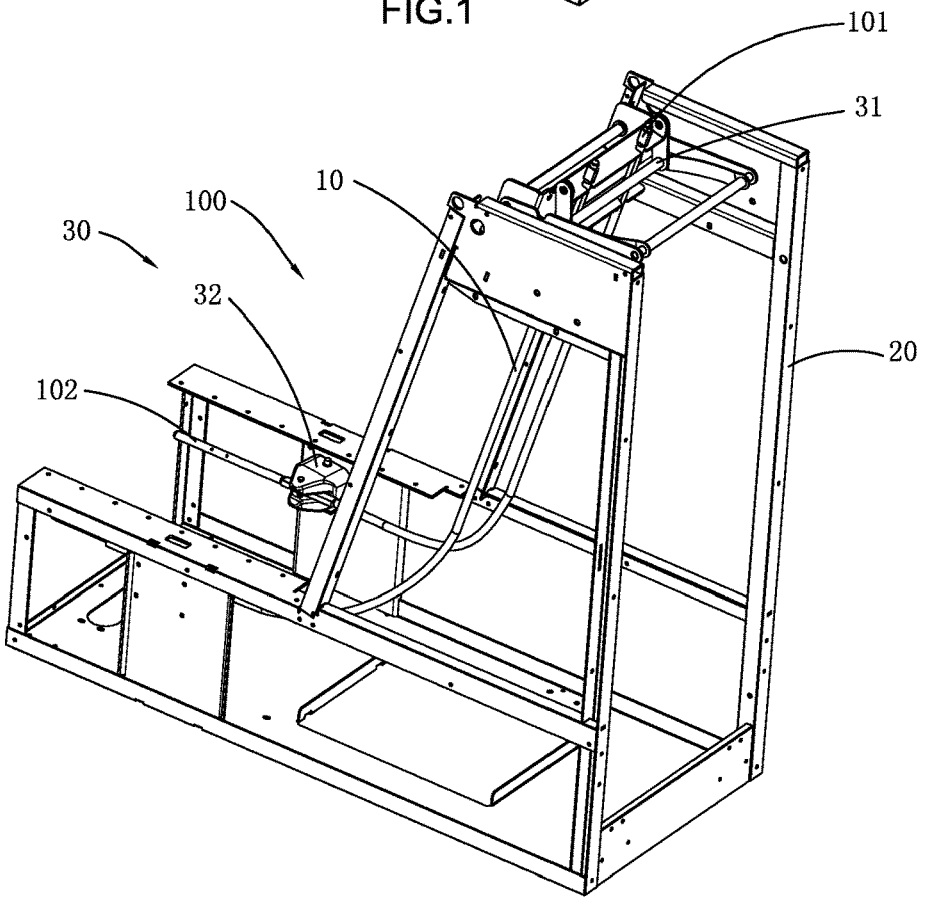
FIG. 2 is a perspective view illustrating releasing of second end portions of two installation arms from a second locking member of the shoe cover dispenser device according to the above preferred embodiment of the present invention.
Figure 3:
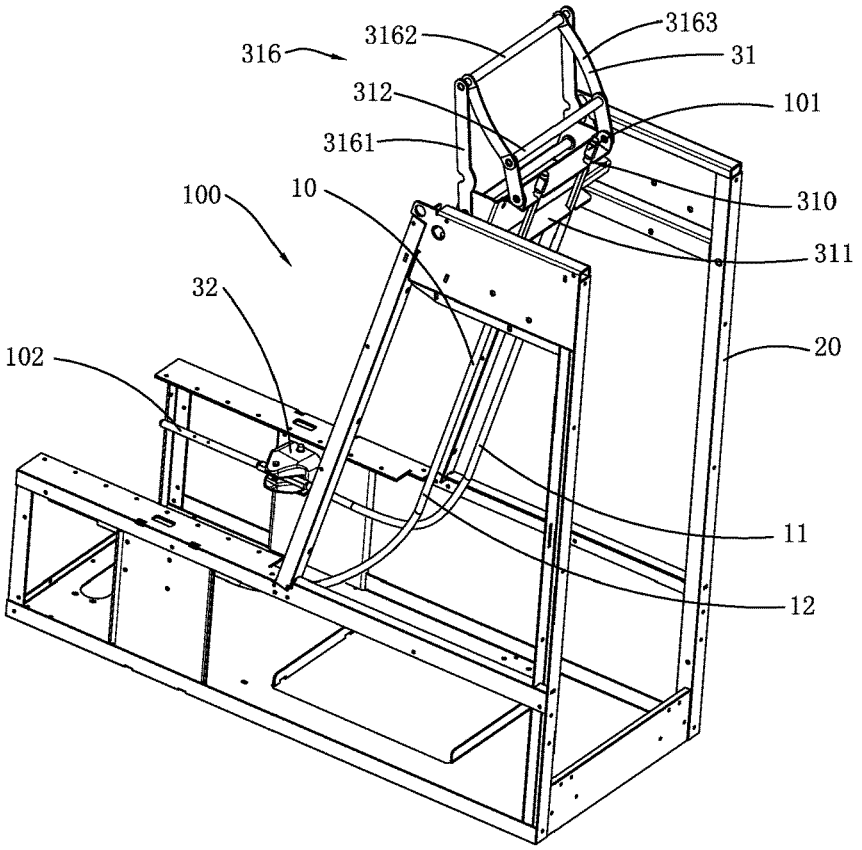
FIG. 3 and FIG. 4 are perspective views illustrating releasing of first end portions of the two installation arms from a first locking member of the shoe cover dispenser device according to the above preferred embodiment of the present invention.
Figure 4:
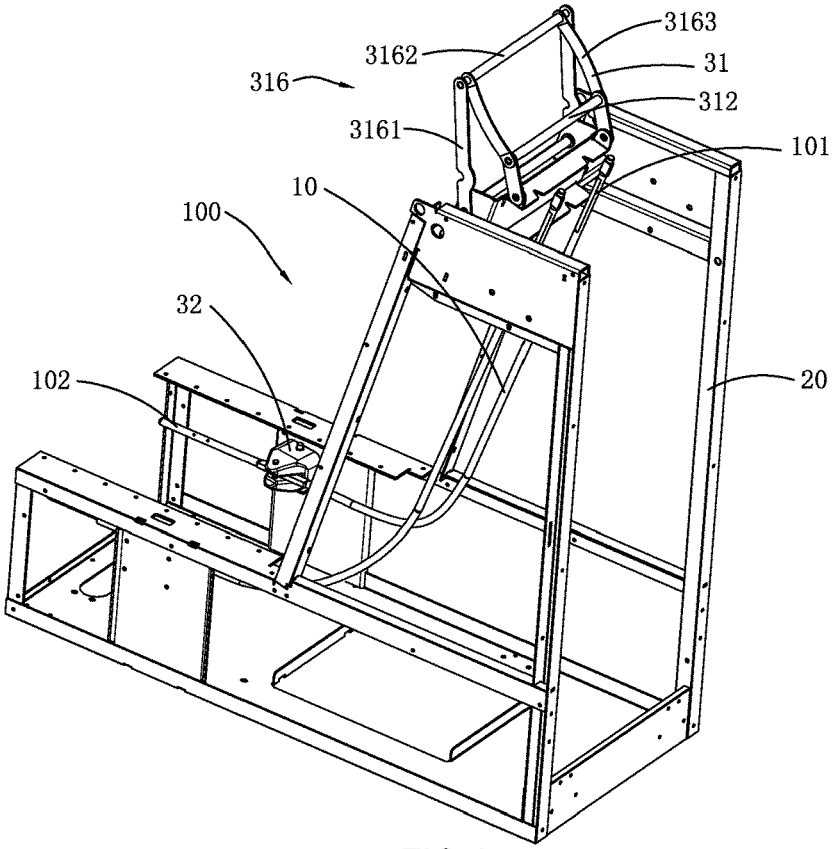
Figure 5A:
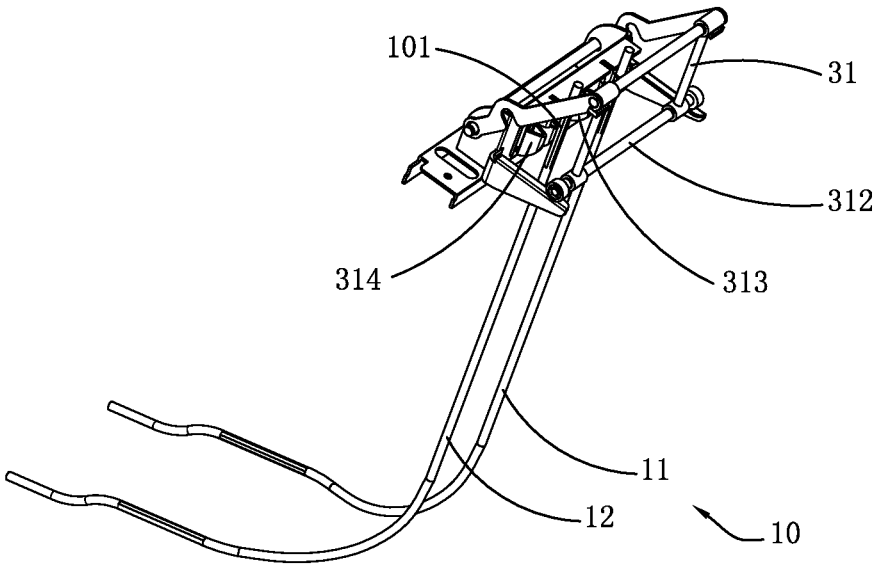
FIGS. 5A to 5B are perspective views illustrate a first locking member of the shoe cover dispenser device according to a first alternative mode of the preferred embodiment of the present invention.
Figure 5B:
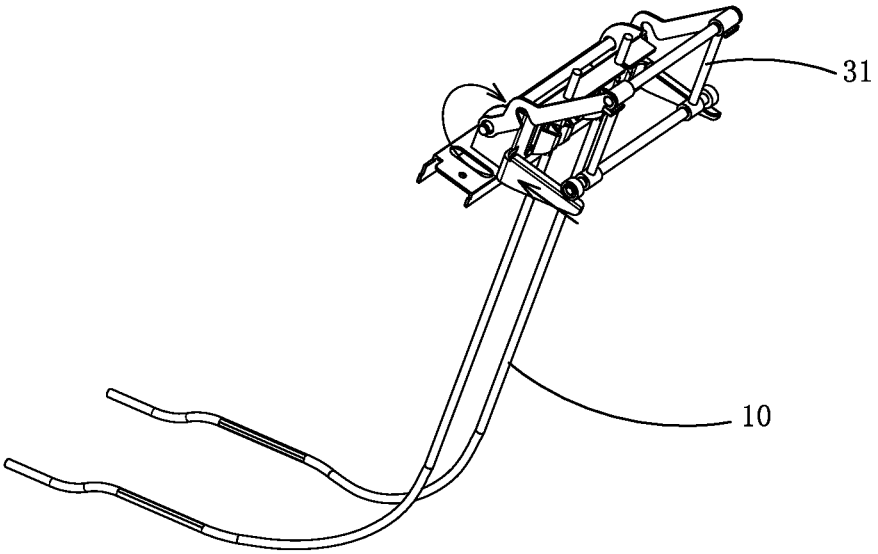
Figure 6A:
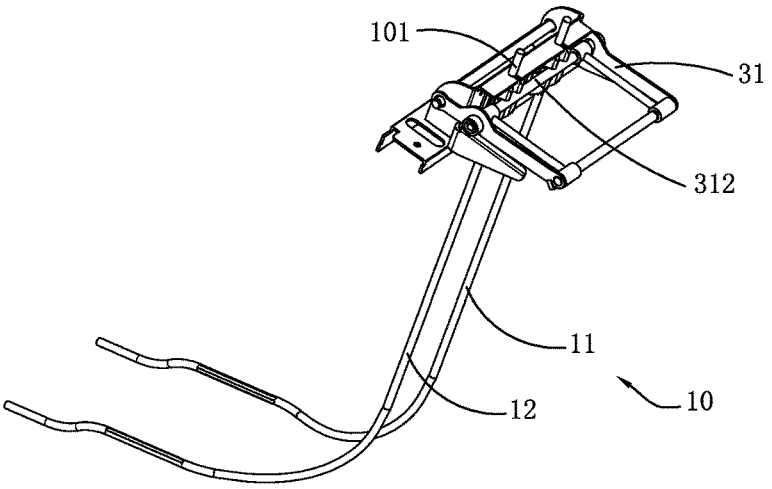
FIG. 6A is a perspective view illustrating the first locking member of the shoe cover dispenser device being in a locked sate according to the first alternative mode of the preferred embodiment of the present invention.
Figure 6B:
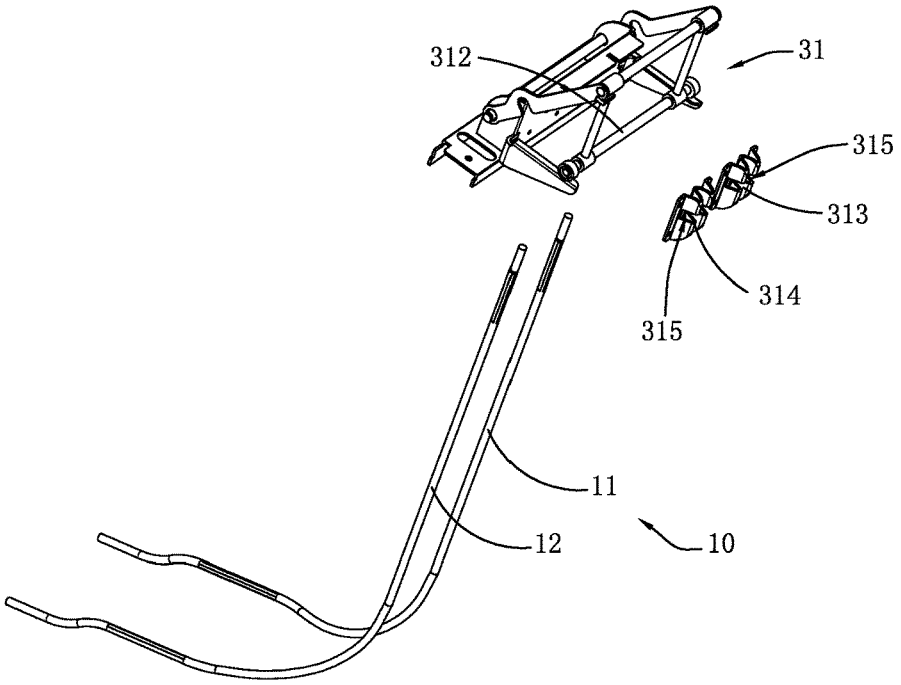
FIG. 6B is an exploded view of the first locking member and the two installation arms of the shoe cover dispenser device according to the first alternative mode of the preferred embodiment of the present invention.
Figure 6C:
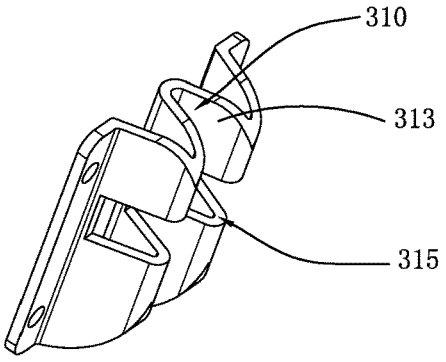
FIG. 6C is a partial enlarged perspective view of a positioning block of the first locking member of the shoe cover dispenser device according to the first alternative mode of the preferred embodiment of the present invention.
Figure 7A:
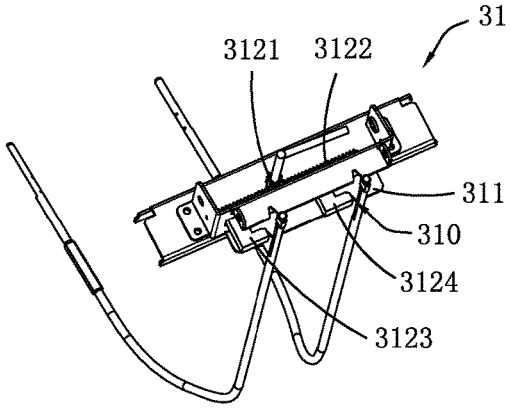
FIGS. 7A and 7B are perspective views illustrating a first locking member of the shoe cover dispenser device according to a second alternative mode of the preferred embodiment of the present invention.
Figure 7B:
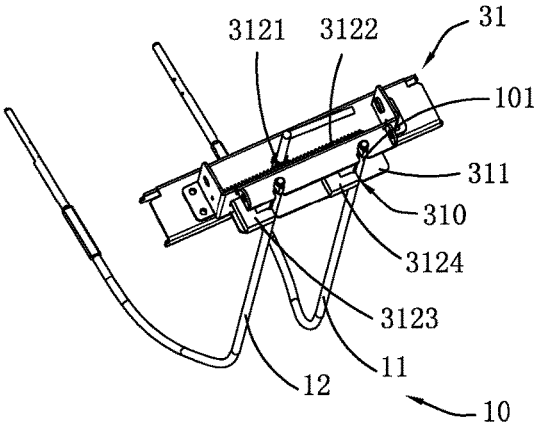
Figure 7C:
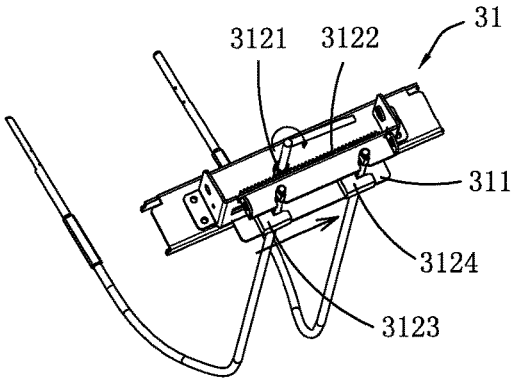
FIG. 7C is a perspective view illustrating the first locking member of the shoe cover dispenser device being in a locked sate according to the second alternative mode of the preferred embodiment of the present invention.
Figure 7D:
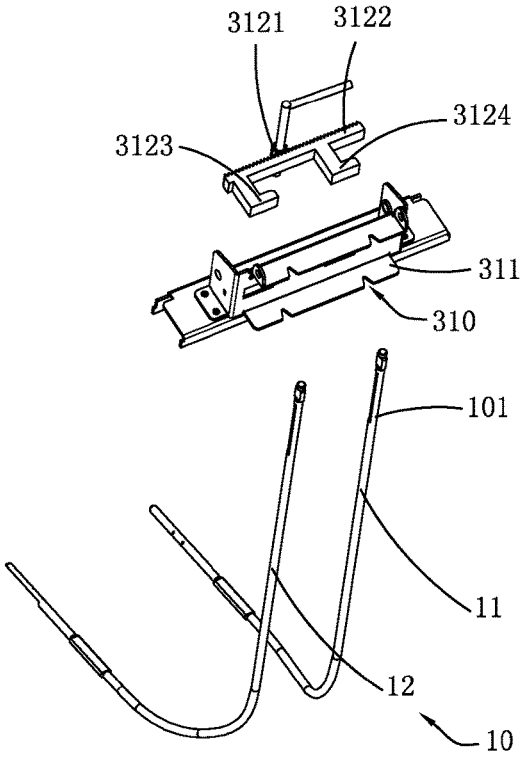
FIG. 7D is an exploded view of the first locking member and the two installation arms of the shoe cover dispenser device according to the second alternative mode of the preferred embodiment of the present invention.

As shown in FIGS. 2 to 4 of the drawings, when the two second end portions 102 are locked by the second locking member 32, the first end portions 101 can be released from the two grooves 310 by operating the first locking member 31 to rotate the positioning member 312. More specifically, the movable frame 316, which is pivotally mounted to the frame 20, comprises two first movable arms 3161 pivotally mounted to the frame 20, a handle 3162 mounted between the two first movable arms 3161, two second movable arms 3163 pivotally mounted to the holding base 311. The positioning member 312 is extended between the two second movable arms 3163. When the handle 3162 is driven to rotate, the movable frame 316 is driven to rotate, so as to drive the positioning member 312 to rotate so as to lock or release the two first end portions 101 of the installation arms 11 and 12.

As shown in FIGS. 5A to 6C which are perspective views of the shoe cover dispenser device 100 according to a first alternative mode of the preferred embodiment of the present invention. Different from the above-mentioned preferred embodiment, in this first alternative mode, the first locking member 31 can be implemented as a locking mechanism comprising a first positioning block 313 and a second positioning block 314, wherein the first positioning block 313 and the second positioning block 314 are substantially W-shaped members, wherein the first end portions 101 of the two installation arms 11 and 12 of the installation assembly 10 can be respectively stored in the W-shaped grooves 310 of the first positioning block 313 and the second positioning block 314. And each of the first positioning block 313 and the second positioning block 314 has a clamping groove 315, the positions of the clamping groove 315 on the first positioning block 313 and the clamping groove 315 on the second positioning block 314 are aligned with each other, and the positioning member 312 can be engaged with the clamping groove 315 of the first positioning block 313 and the clamping groove 315 of the second positioning block 314 after being reversedly rotated for biasing against the two installation arms 11 and 12, thereby completing the alignment of the first positioning block 313 and the second positioning block 314, so that the first end portions 101 of the two installation arms 11 and 12 of the installation assembly 10 can be fixed by the first locking member 31.

As shown in FIGS. 7A to 7D which are perspective views of the shoe cover dispenser device 100 according to a second alternative mode of the preferred embodiment of the present invention. The difference from the above-mentioned preferred embodiment is that in this second alternative mode, the positioning member 312 in the first locking member 31 is implemented as a gear-rack structure which comprises a gear 3121 and a rack 3122 cooperated to move with respect to the gear 3121, and the rotary motion of the gear 3121 can actuate the linear motion of the rack 3122.

Further, the rack 3122 comprises a first stop arm 3123 and a second stop arm 3124, and the first end portions 101 of the two installation arms 11 and 12 of the installation assembly 10 can be retained in the first stop arm 3123 and the second stop arm 3124, so as to realize the fixing of the two installation arms 11 and 12 of the installation assembly 10 in the two grooves 310 on the holding base 311, so as to realize fixation of the first end portions 101 of the two installation arms 11 and 12 of the installation assembly 10.

Figure 8A:
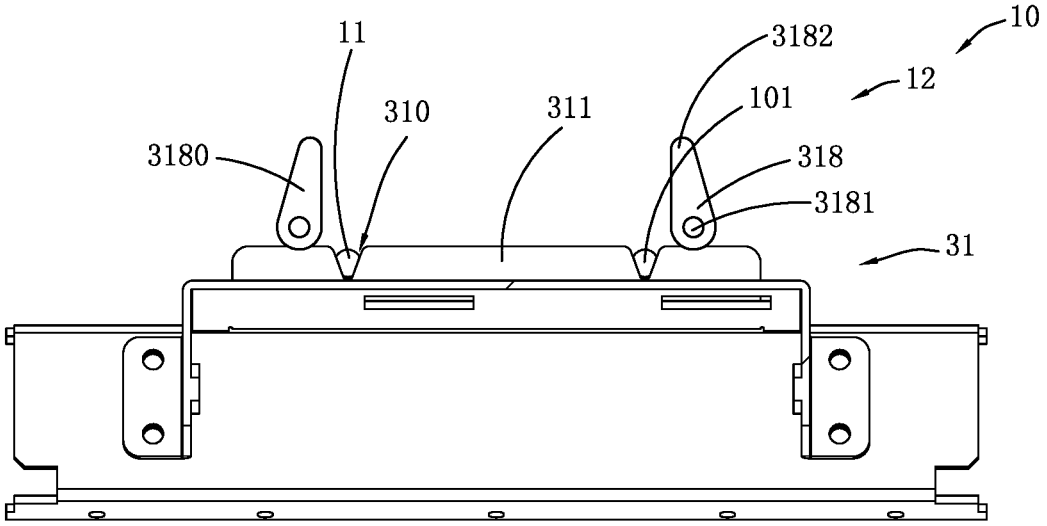
FIG. 8A is a perspective view illustrating the first locking member of the shoe cover dispenser device being in an unlocked state according to a third alternative mode of the preferred embodiment of the present invention.
Figure 8B:
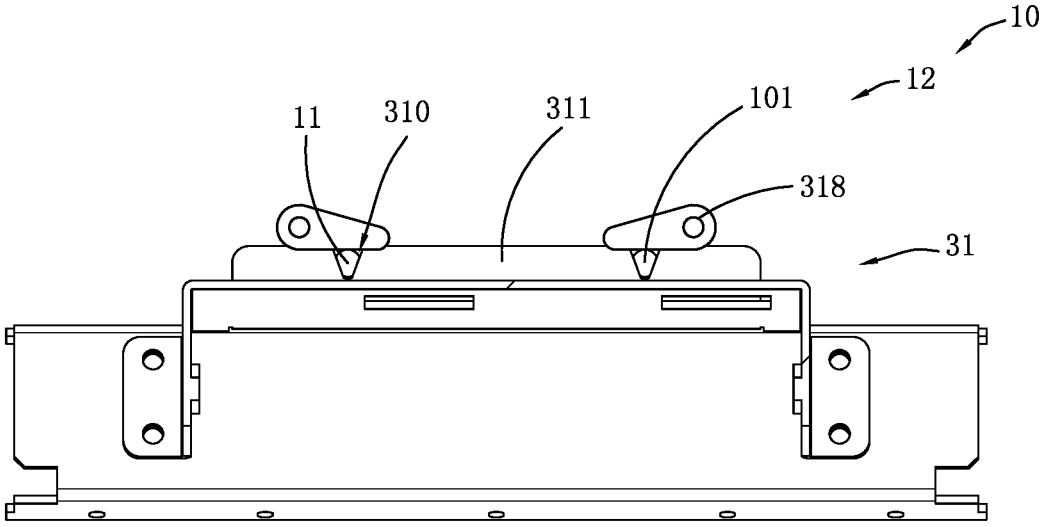
FIG. 8B is a perspective view illustrating the first locking member of the shoe cover dispenser device being in a locked state according to the above third alternative mode of the preferred embodiment of the present invention

As shown in FIGS. 8A to 8B, which are perspective views of preferred embodiment, the shoe cover dispenser device 100 according to a third alternative mode of the preferred embodiment of the present invention. The difference from the above-mentioned preferred embodiment is that in this third alternative mode, the positioning member 312 in the first locking member 31 is implemented as an eccentric mechanism 318, wherein the eccentric mechanism 318 is mounted near the two grooves 310 in the holding base 311, wherein an eccentric wheel 3181 of the eccentric mechanism 318 can rotate along the holding base 311, so that the holding arm end portion 3182 of the eccentric mechanism 318 can hold to stop the first end portions 101 of the installation arms 11 and 12 of the installation assembly 10 after rotating, so that the first end portions 101 of the two installation arms 11 and 12 of the installation assembly 10 are fixed to the holding base 311.

In addition, one skilled in the art can adjust the structure of the positioning member 312 in the first locking member 31 of the shoe cover dispenser device 100 according to the actual situation, such as adjusting the positioning members 312 in the first locking member 31. For example, the positioning member 312 can be a shifter lever and so on.

Figure 9A:
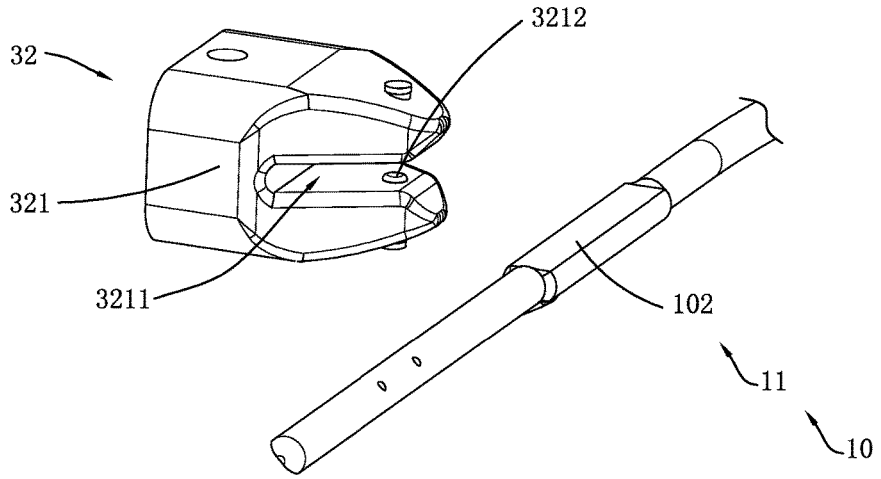
FIGS. 9A and 9B are perspective view illustrating a second locking member of the shoe cover dispenser device according to the above preferred embodiment of the present invention.
Figure 9B:
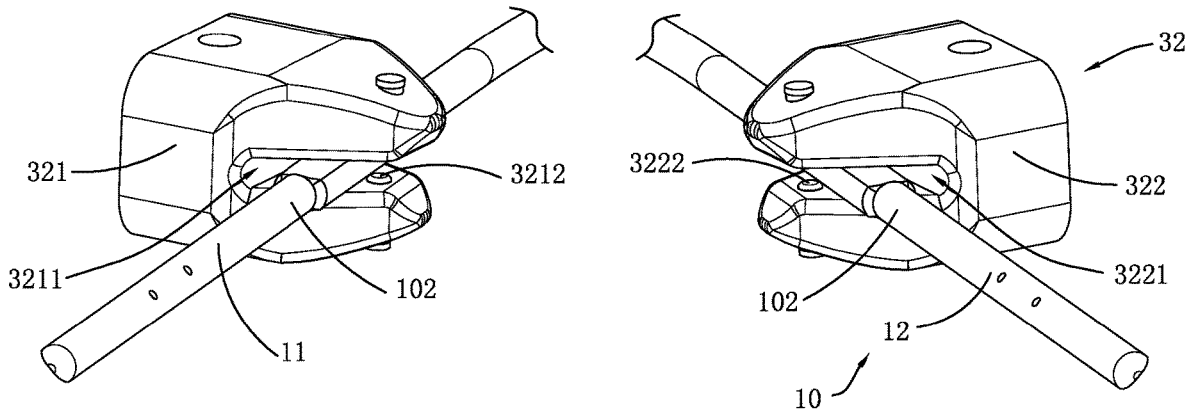
Figure 10A:
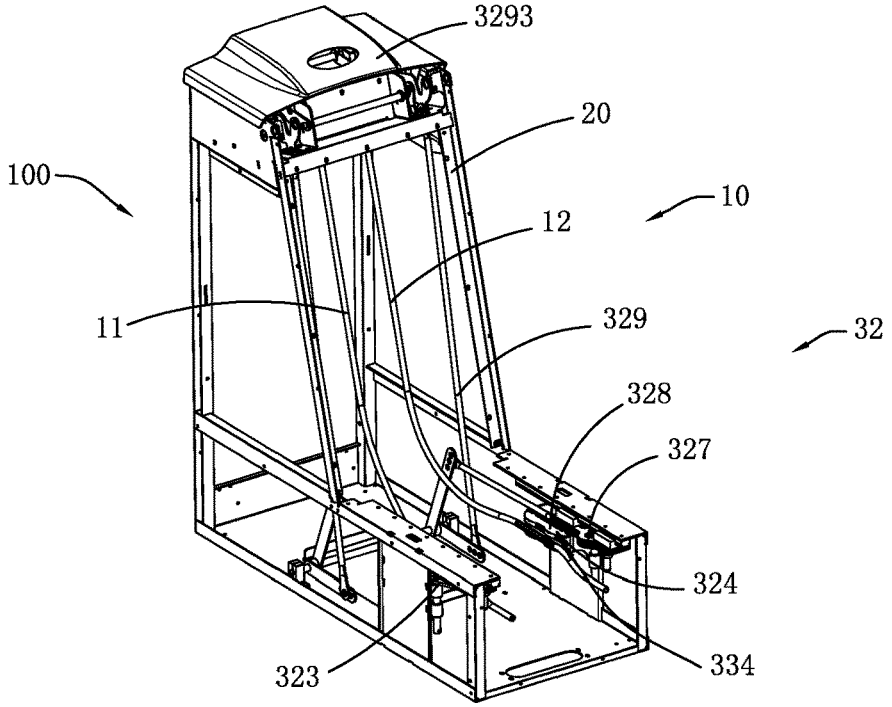
FIGS. 10A-10C are perspective views of the shoe cover dispenser device according to a fourth alternative mode of the preferred embodiment of the present invention.
Figure 10B:
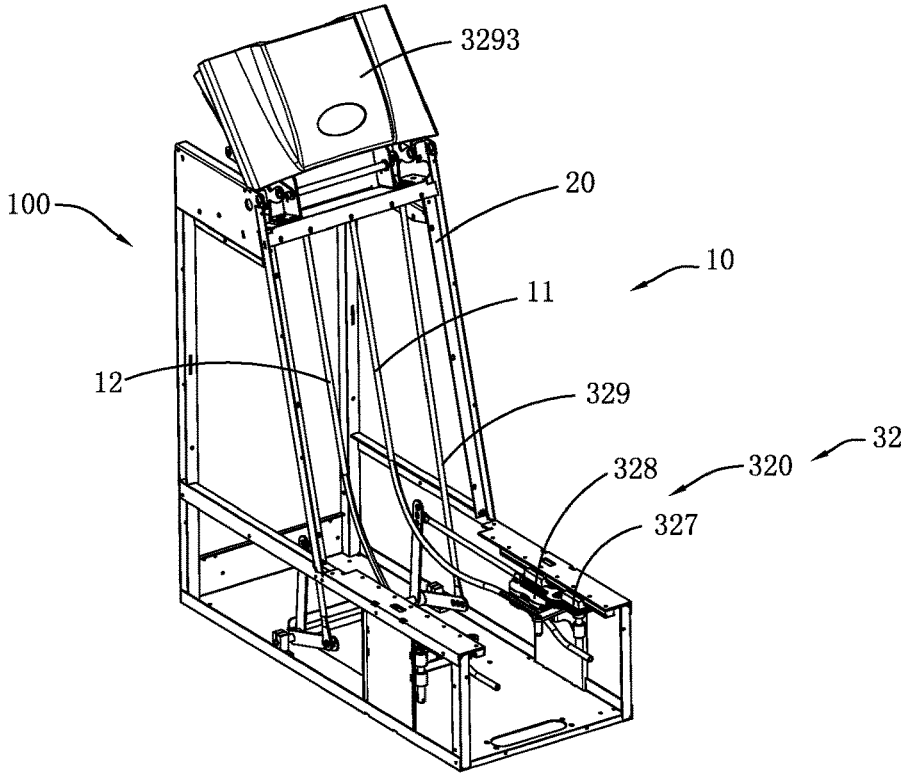
Figure 10C:
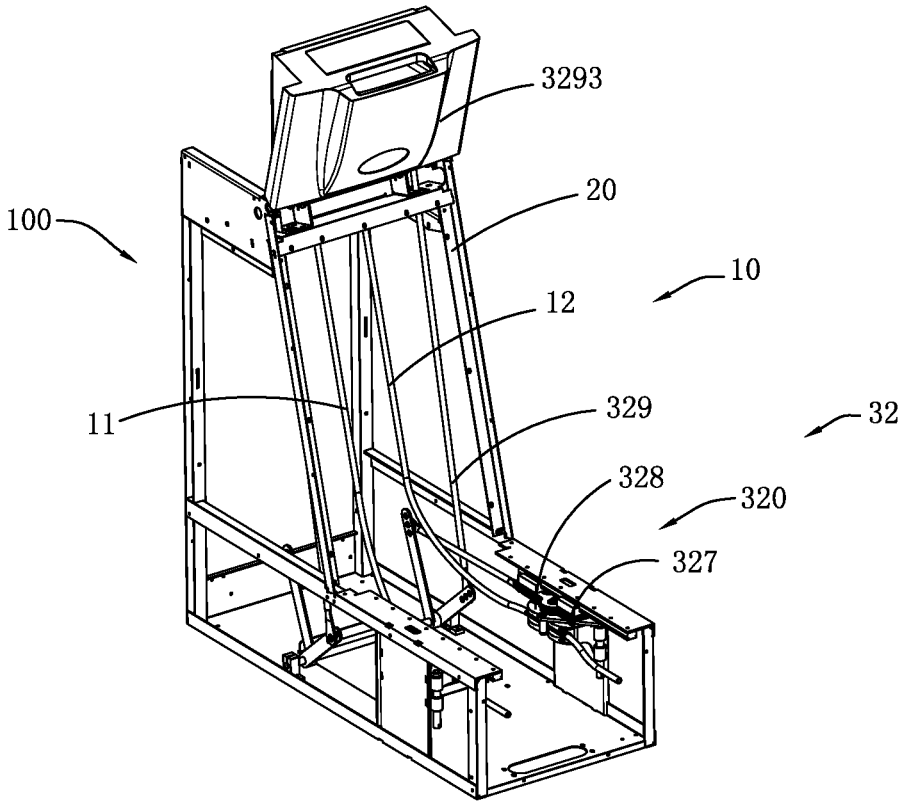

FIGS. 9A to 9B are perspective views illustrating the second locking member of the preferred embodiment of the shoe cover dispenser device 100 of the present invention. The second locking member 32 has two slots, and two second end portions 102 of the installation arms 11 and 12 of the installation assembly 10 can be fixed to the two slots respectively, thereby fixing the two installation arms 11 and 12 of the installation assembly 10 to the frame 20. At this time, the first end portions 101 of the two installation arms 11 and 12 can be free end portions, so a series of shoe covers 90 can be mounted on the installation assembly 10 through the first end portions 101 of the two installation arms 11 and 12.

The second locking member 32 which is mounted to the frame 20 is configured to comprise a first holding member 321 and a second holding member 322, wherein the first holding member 321 has a first slot 3211 and comprises at least one first locking ball 3212. The first locking ball 3212 holding member 321 is movable holding member 321 can allow the second end portion 102 of the installation assembly 10 to be locked in the first slot 331.

The second holding member 322 has a second locking slot 3221 and comprises at least one second locking ball 3222, wherein the second locking ball 3222 is movable to allow the second end portion 102 of the installation assembly 10 to be locked in the second slot 332.

In other words, when the second end portions 102 of the two installation arms 11 and 12 of the installation assembly 10 are respectively placed in the first slot 3211 of the first holding member 321 and the second slot 3221 of second holding member 322, the second end portions 102 of the two installation arms 11, 12 of the installation assembly 10 can be locked by locking the first locking ball 3212 and the second locking ball 3222, thereby locking the installation assembly 10 fixedly connected to the frame 20. So that when the first end portions 101 of the two installation arms 11, 12 of the installation assembly 10 are released from the first locking member 31, a plurality of the shoe covers 90 is mounted to the shoe cover dispenser device 100 through the first end portion 101 of the two installation arms 11, 12 of the installation assembly 10.

Further, the first holding member 321 and the second holding member 322 are configured to be able to move laterally and longitudinally with respect to the frame 20, so as to increase fitness between the two end portions of the second installation arms 11 and 12 of the two installation arms 11 and 12 of the installation assembly 10 and the first slot 331 and the second slot 332.

Furthermore, the first holding member 321 and the second holding member 322 can be movably connected to the frame 20, so that the position of the first slot 3211 of the first holding member 321 and the second slot 3221 of the second holding member 322 can be adjusted relative to the positions of the second end portions 102 of the two installation arms 11 and 12 of the installation assembly 10, so that when the positions of the two installation arms 11 and 12 of the installation assembly 10 and the first holding portion and the second holding member 322 are not aligned with each other, and the relative positions of the first holding member 321 and the second holding member 322 can also be adjusted to make the second end portions 102 of the two installation arms 11 and 12 of the installation assembly 10 are respectively engaged with the first holding member 321 and the second holding member 322 to complete the fixing of the second end portions 102 of the two installation arms 11 and 12 of the installation assembly 10.

As shown in FIG. 10A to FIG. 11K, the shoe cover dispenser device 100 according to a fourth alternative mode of the preferred embodiment of the present invention is illustrated. The difference from the above-mentioned preferred embodiment is that in this fourth alternative mode, the second locking member 32 is configured to comprise two locking system 320 each comprises a guiding mechanism 327, a locking unit 328, and a transmission mechanism 329. The guiding mechanism 327 is fixedly connected to the end of the transmission mechanism 326 so as to be able to move when it is driven by the transmission mechanism 326, and can secure the installation assembly 10 to the second locking member 32. The locking unit 328 can be embodied to comprises the two holding members 321 and 322, or other suitable structure that can be arranged to detachably fix the two second end portions 102 of the installation arms 11 and 12.

The transmission mechanism 329 is implemented as a transmission mechanism 329 which comprises a crank 3291 and an actuating mechanism 3292, wherein the crank 3291 works as an active driving member, so that the rotation of the crank 3291 is converted by the transmission mechanism 329 to actuate the displacement of the actuating mechanism 3292.

The guiding mechanism 327 comprises a displacement mechanism 3271, a control mechanism 3272 and a sliding member 3273. The sliding member 3273 is arranged on the displacement mechanism 3271 and is fixedly connected to the control mechanism 3272 so that the control mechanism 3272 can be used to be driven by the sliding member 3273 to move along with the movement of the displacement mechanism 3271, wherein the displacement mechanism 3271 is fixed to an end of the transmission mechanism 329. The control mechanism 3272 comprises a guide rod 32721, a pusher member 32722, and a pivot shaft 32723 mounted to the frame 20, wherein the guide rod 32721 pivotally connected to the pivot shaft 32723 and is arranged to be extended outward from the end of the actuating mechanism 3292 and can move along with the actuating mechanism 3292, so that a displacement of the guide rod 32721 with respect to the frame 20 is performed, the pusher member 32722 is extended downwardly from the guide rod 32721, and the first end portions 101 of the two installation arms 11 and 12 of the installation assembly 10 are arranged between the pusher member 32722 and the guide rod 32721, so that the second end portions 102 of the two installation arms 11 and 12 of the installation assembly 10 can be biased against by the pusher member 32722 to move to a state in which the second end portions 102 of the two installation arms 11 and 12 are retained and fixed by the two second locking units 328. And when the control mechanism 3272 is moved away from the two installation arms 11 and 12, the second end portions 102 of the two installation arms 11 and 12 are not retained by the two locking units 328, so that the second end portions 102 of the two installation arms 11 and 12 can be free end portions for dispensing the shoe covers 90.

In the fourth alternative mode of the preferred embodiment of the shoe cover dispenser device 100 of the present invention, a cross rod 200 is provided on the frame 20, and the cross rod 200 is configured to be fixed to the bottom of the frame 20. The actuating mechanism 3292 comprises a first connecting rod 32921, a second connecting rod 32922, a third connecting rod 32923, and a fourth connecting rod 32924, wherein the first connecting rod 32921 is hingedly connected with the crank 3291, so that the first connecting rod 32921 realizes up and down movement under the rotation of the crank 3291. At the same time, the first connecting rod 32921 is able to drive the second connecting rod 32922 to rotate, the second connecting rod 32922 and the third connecting rod 32923 are movably connected to the cross rod 200, and the second connecting rod 32922 and the third connecting rod 32923 are rotatable with the cross rod 200. The fourth connecting rod 32924 is movably connected to the third connecting rod 32923 and can be driven to move by the third connecting rod 32923, and the displacement mechanism 3271 is fixedly connected to the fourth connecting rod 32924 so that the displacement mechanism 3271 can perform forward and backward reciprocating displacement movement relative to the cross rod 200 under the driving of the fourth connecting rod 32924.

Therefore, when the crank 3291 rotates, the first connecting rod 32921 is driven to move up and down, and the up and down movement of the first connecting rod 32921 simultaneously drives the second connecting rod 32922 to rotate with respect to the cross rod 200, and the rotational movement of the second connecting rod 32922 will correspondingly drive the third connecting rod 32923 to rotate with respect to the cross bar 200, so that the fourth connecting rod 32924 is driven by the third connecting rod 32924 to move, thereby driving the displacement mechanism 3271 to perform corresponding forward and backward displacement movements.

The displacement mechanism 3271 comprises a retaining surface 32710 defining a displacement groove 32711. The retaining surface 32710 is an inner side surface which comprises a retention surface 327101 which can be an inclined surface or a curved surface, and a straight surface 327102, the retention surface 327101 and the straight surface 327102 are smoothly transitioned, and the sliding member 3273 is arranged in the displacement groove 32711, and the sliding member 3273 can slide along the retaining surface 32710.

The sliding member 3273 is fixedly connected to the guide rod 32721 in the control mechanism 3272, so when the displacement mechanism 3271 moves forward and backward, the sliding member 3273 is driven by the retaining surface 3271 to slide along the retaining surface 32710 of the displacement groove 32711, so as to drive the guide rod 32721 in the control mechanism 3272 to pivotally rotate.

Since the pusher member 32722 is fixedly connected to the guide rod 32721, the pusher member 32722 will be driven by the guide rod 32721 to rotate to push against the second end portion 102 of the installation arms 11 and 12 of the installation assembly 10 pusher member 32722, so that the two second end portions 102 of the installation arms 11 and 12 of the installation assembly 10 will be driven to move along with the displacement of the guide rod 32721, and thus the two second end portions 102 of the installation arms 11 and 12 can be moved to positions that are locked by the second locking unit 328.

In other words, the locking unit 328 of the second locking member 32 may comprises the first holding member 321 and the second holding member 322 the two second end portions 102 of the two installation arms 11 and 12 of the installation assembly 10 can be respectively engaged in the first slot 3211 and the second slot 3221 under the operation of the transmission mechanism 329 and the pusher member 32722 of the control mechanism 3272, so as to realize the locking of the two installation arms 11 and 12 of the installation assembly 10.

Preferably, in the fourth alternative mode of the present invention, each crank 3291 is implemented as a component of a cover frame 3293, and the cover frame 3293 is movably connected to the frame 20*s*. Therefore, as described above, when the cover frame 3293 is rotated, the guiding mechanism 327 can be driven to move and finally the two installation arms 11 and 12 of the installation assembly 10 are driven to be locked or released.

However, the specific implementation of the present invention is not limited to this. Those skilled in the art can determine the specific structure in the displacement mechanism 3271 according to the actual situation, as long as the sliding member can be realized under the driving of the displacement mechanism 3271 left and right. In other words, as long as the same or similar technical solutions as the present invention are adopted on the basis of the above disclosure of the present invention, the same or similar technical problems as the present invention are solved, within the protection scope of the present invention and the same or similar technical solutions as the present invention are achieved.

As shown in FIGS. 11G to 11K of the drawings, the first locking member 31 and the second locking member 32 of the locking assembly 30 is interlocked with each other. More specifically, when the locking assembly 30 is operated to drive the first locking member 31 locks the two first end portions 101 of the installation arms 11 and 12, the two second end portions 102 of the installation arms 11 and 12 are simultaneously released from the second locking member 32, when the locking assembly 30 is operated to drive the first locking member 31 releases the two first end portions 101 of the installation arms 11 and 12, the two second end portions 102 of the installation arms 11 and 12 are simultaneously locked by the second locking member 32.

Figure 11A:
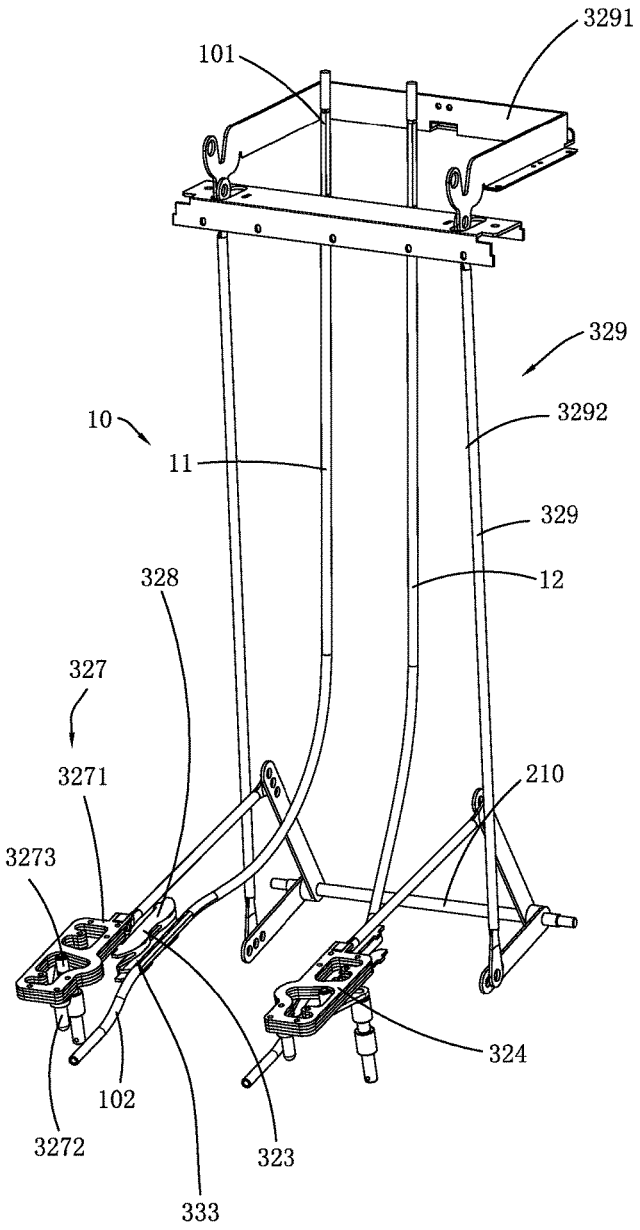
FIG. 11A is a perspective view illustrating a second locking member of the shoe cover dispenser device according to the fourth alternative mode of the preferred embodiment of the present invention.
Figure 11B:
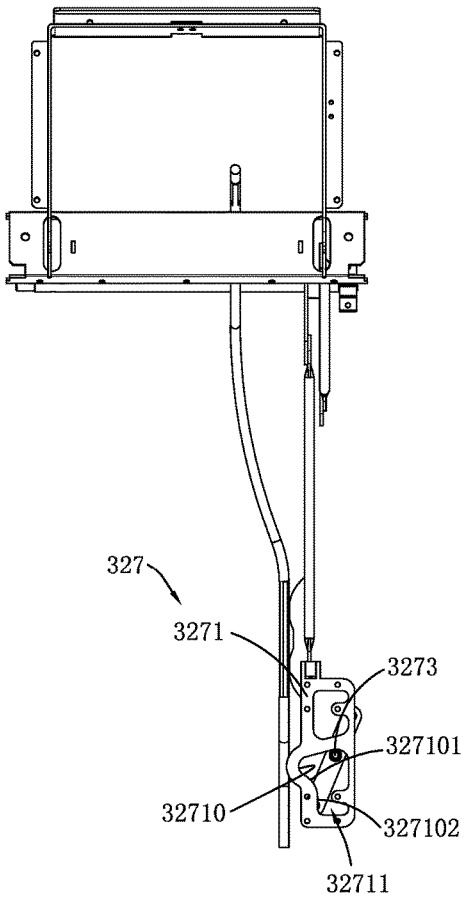
FIG. 11B is a top side view illustrating the second locking member of the shoe cover dispenser device according to the fourth alternative mode of the preferred embodiment of the present invention.
Figure 11C:
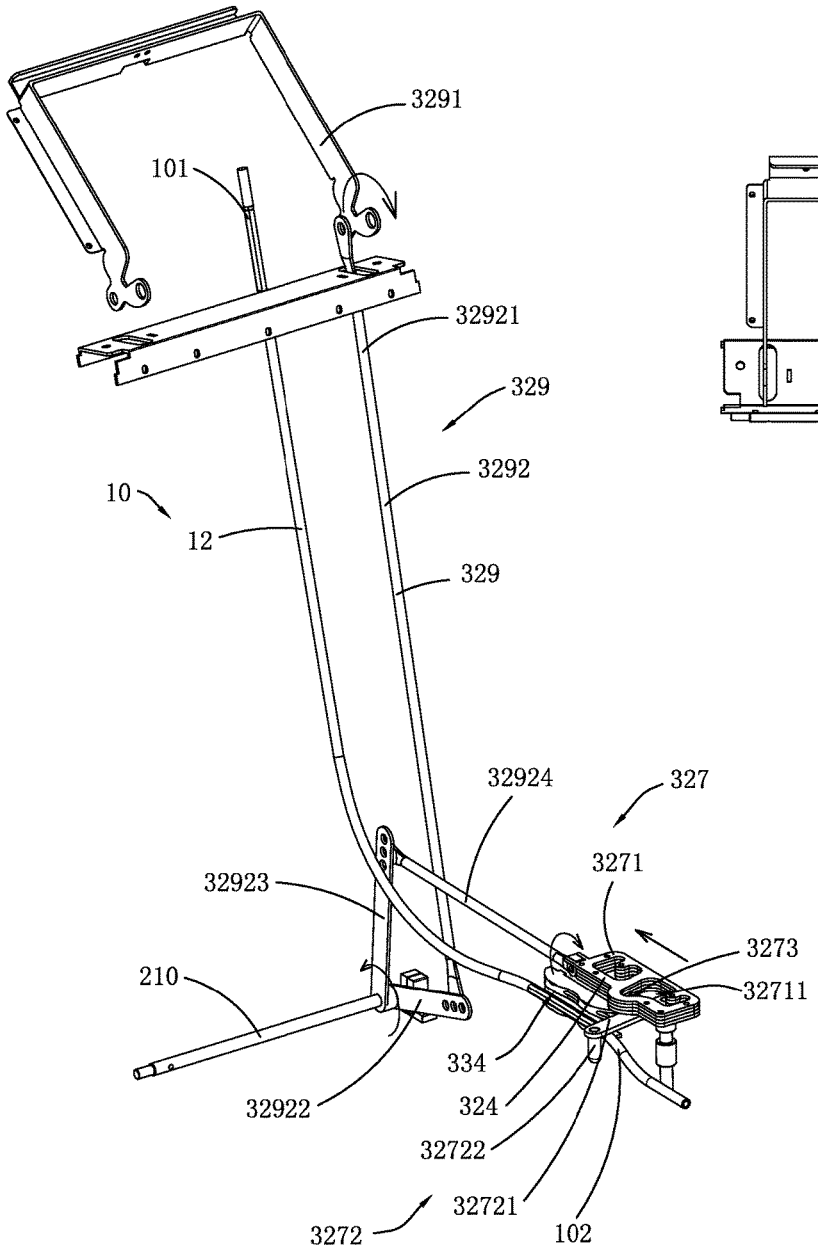
FIGS. 11C to 11F are schematic views illustrating operation of the second locking member for locking the second end portions of the two installation arms of the shoe cover dispenser device according to the fourth alternative mode of the preferred embodiment of the present invention.
Figure 11D:
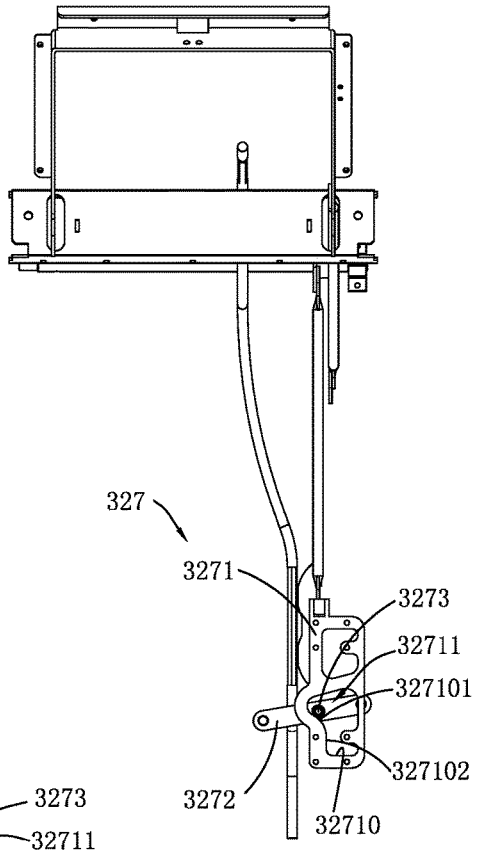
Figure 11E:
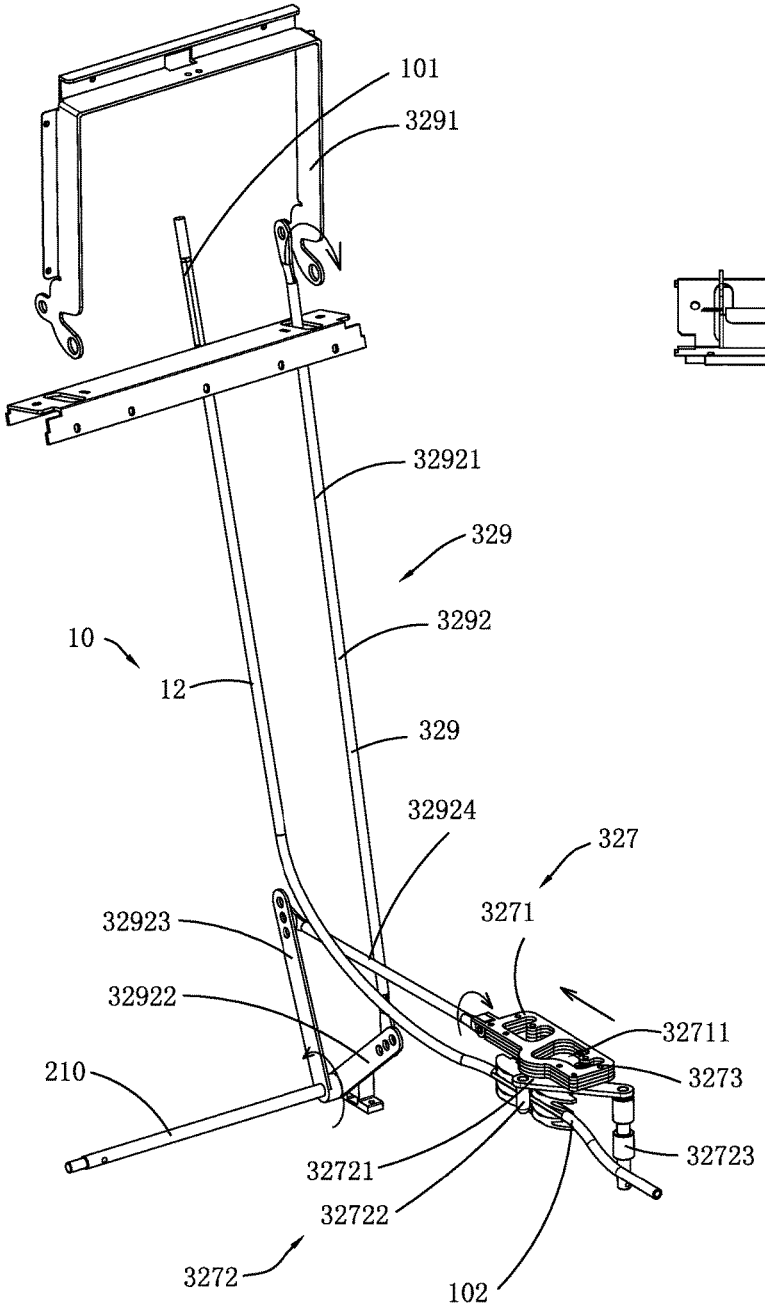
Figure 11F:
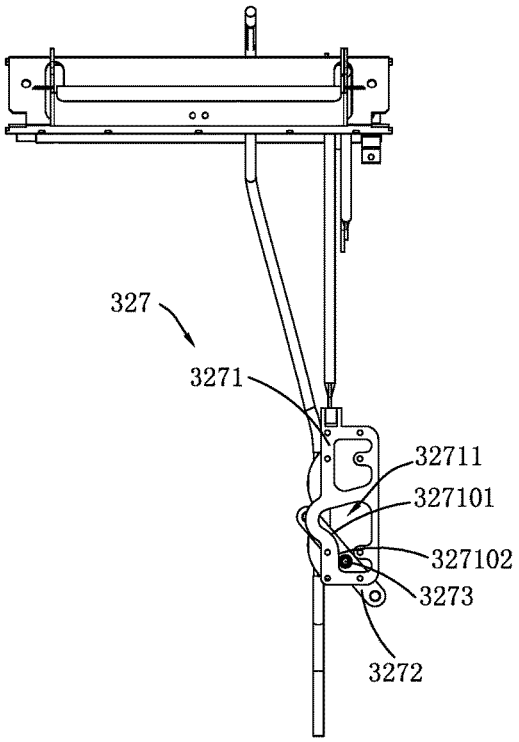
Figure 11H:
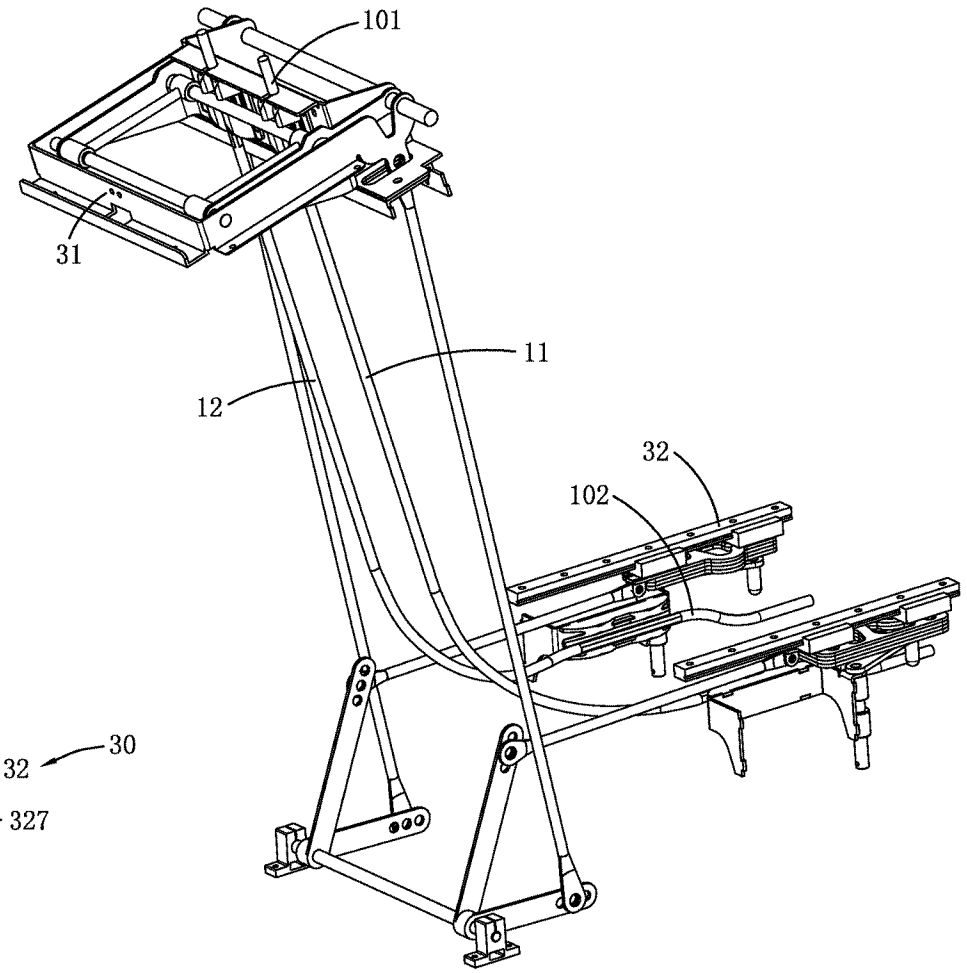
FIGS. 11G to 11H are perspective views illustrating the linked first locking member and second locking member of the shoe cover dispenser device according to the fourth alternative mode of the preferred embodiment of the present invention.
Figure 11G:
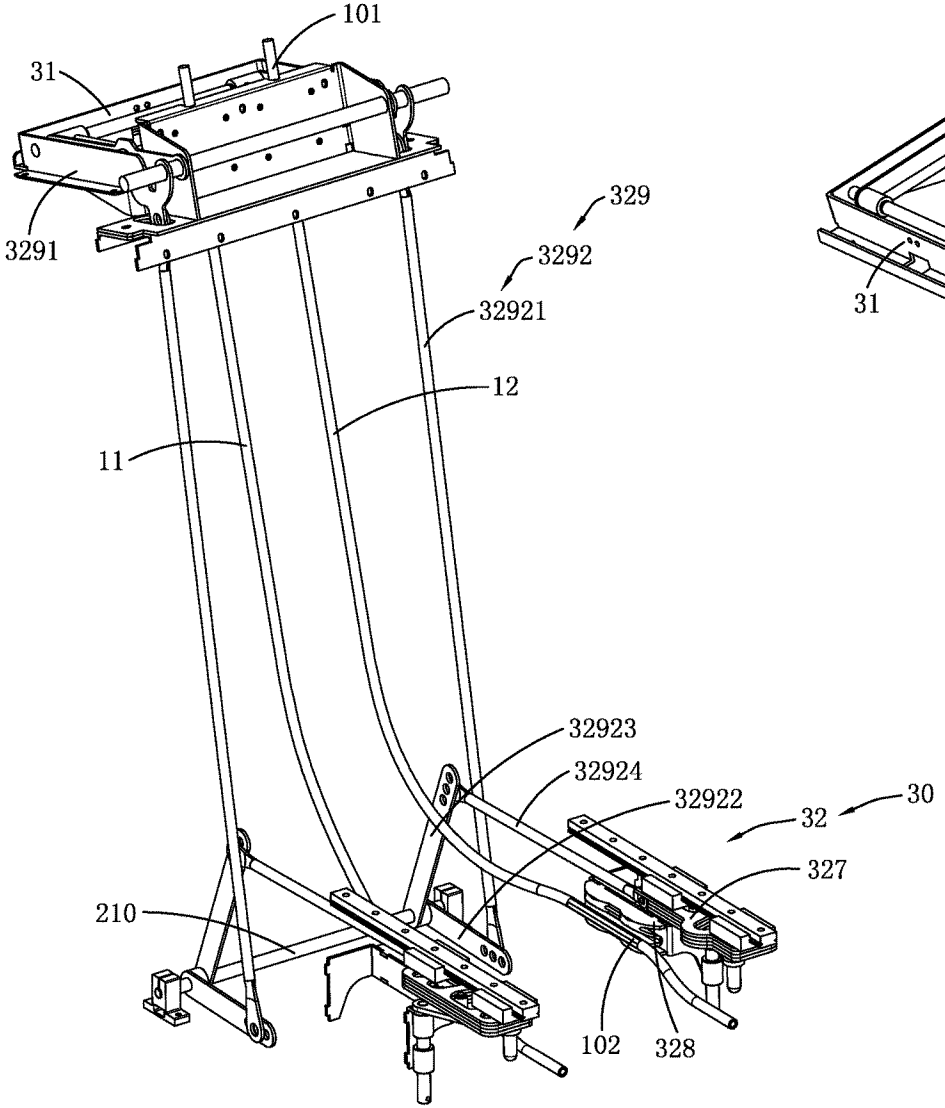
Figure 11J:
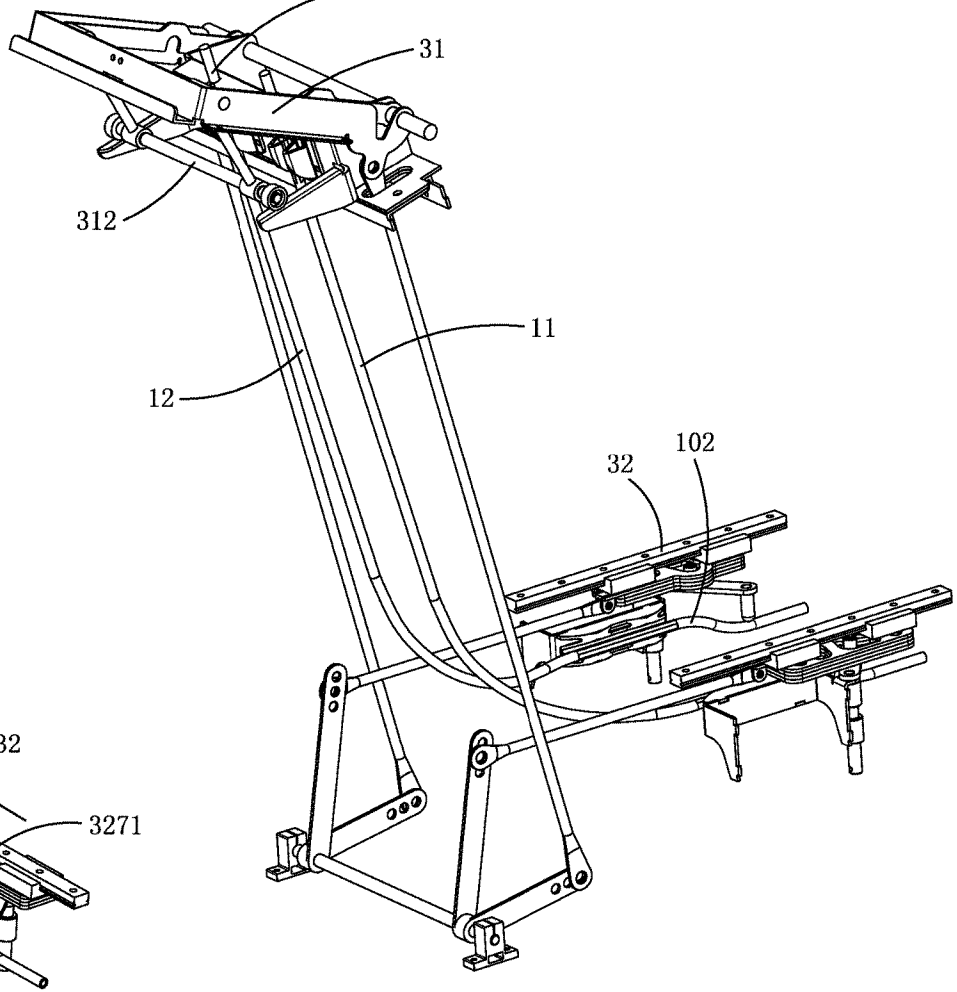
FIGS. 11I to 11L are perspective views illustrating the linkage operation of the linked first locking member and second locking member of the shoe cover dispenser device according to the fourth alternative mode of the preferred embodiment of the present invention.
Figure 11I:
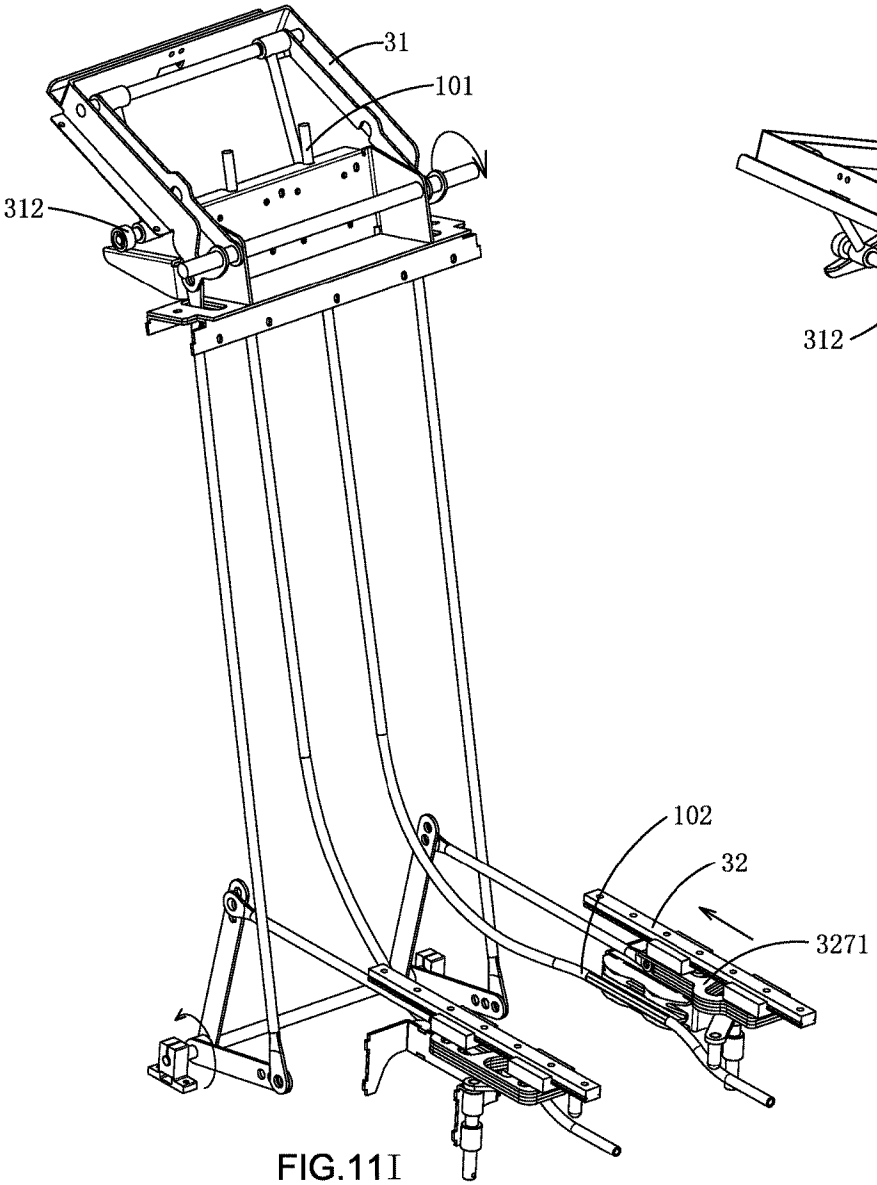
Figure 11L:
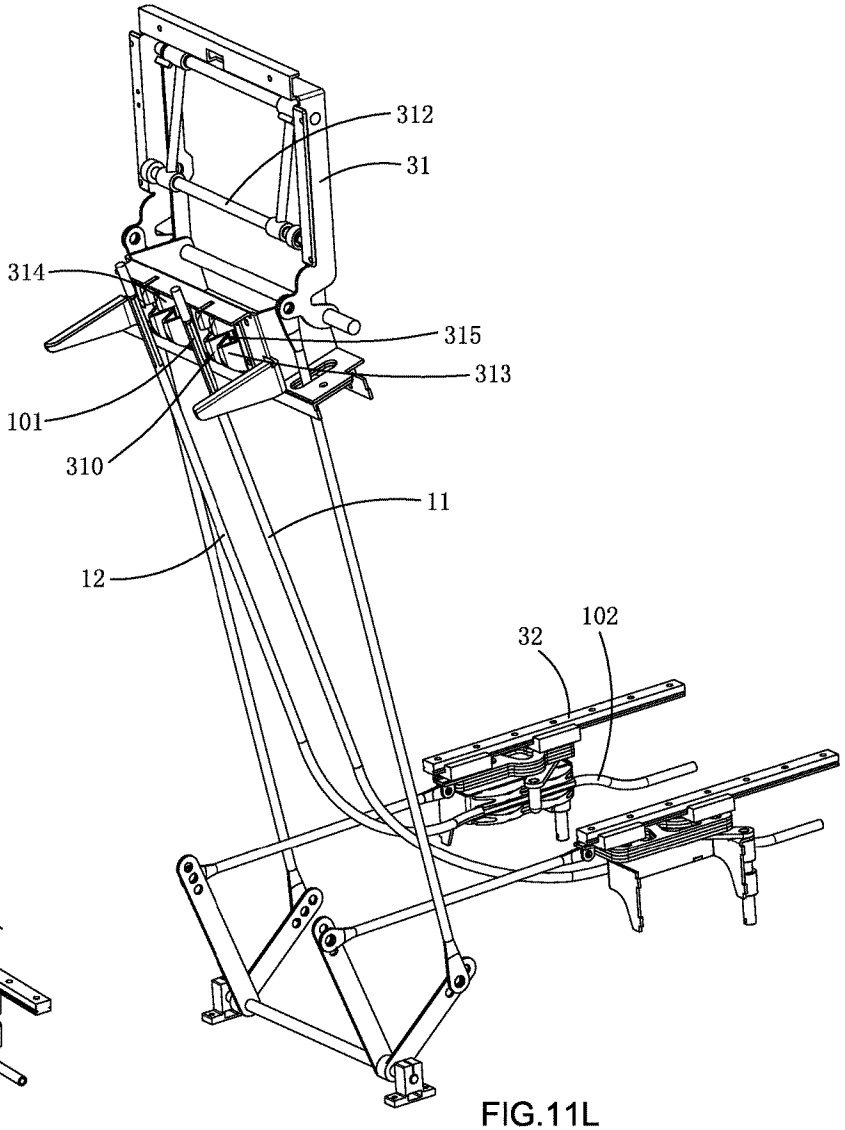
Figure 11K:
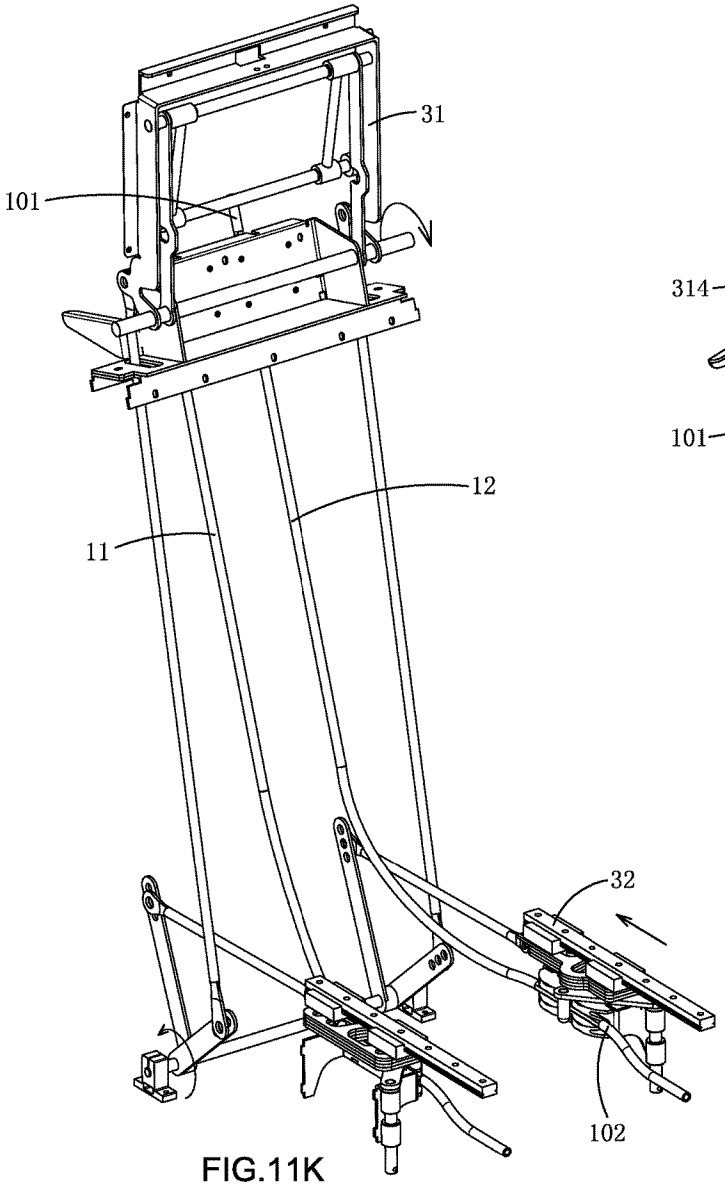
Figure 12A:
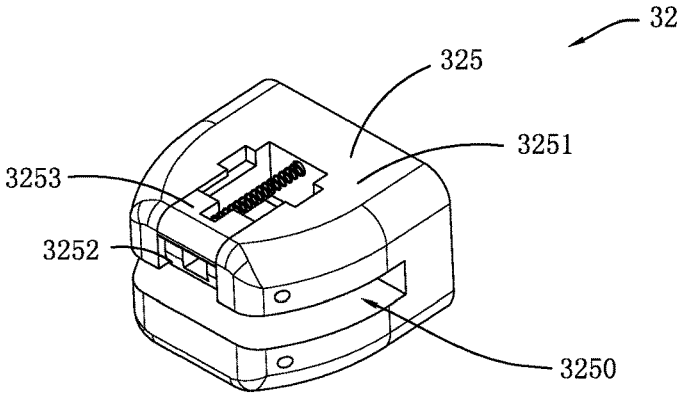
FIG. 12A is a perspective view illustrating a second locking member of—the shoe cover dispenser device according to a fifth alternative mode of the preferred embodiment of the present invention.
Figure 12B:
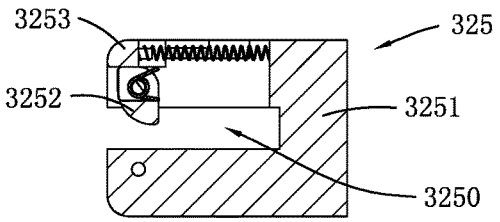
FIGS. 12B to 12H are sectional views illustrating operation of the second locking member for locking or releasing the second end portions of the two installation arms of the shoe cover dispenser device according to the fifth alternative mode of the preferred embodiment of the present invention
Figure 12C:
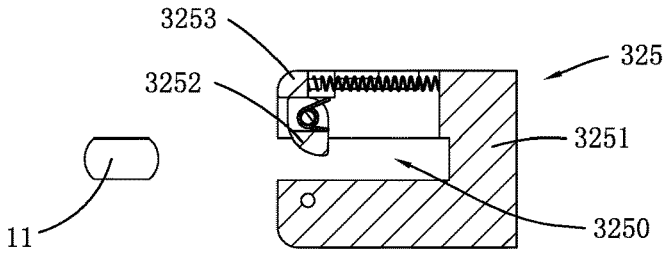
Figure 12D:
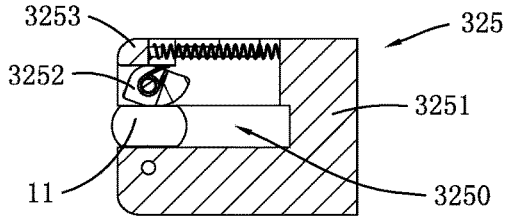
Figure 12E:
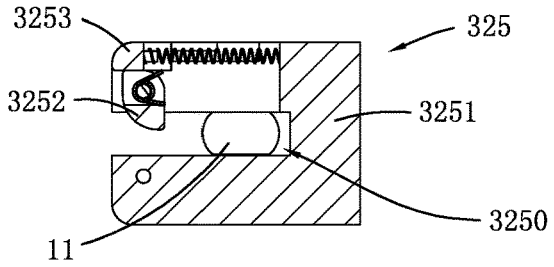
Figure 12F:
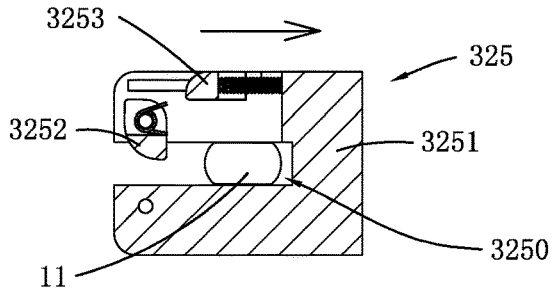
Figure 12G:
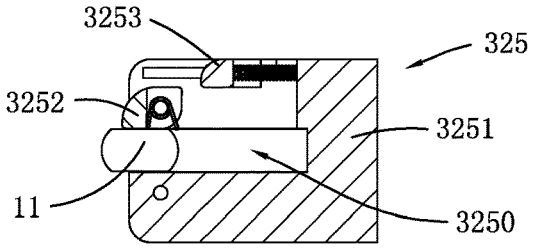
Figure 12H:
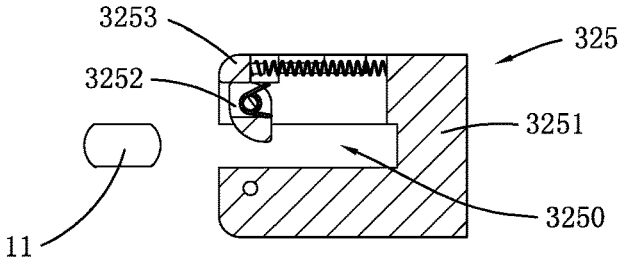

As shown in FIGS. 11G and 11H of the drawings, during a normal working state of the shoe cover dispenser device of this fourth alternative mode of the preferred embodiment of the present invention, the two second end portions 102 of the installation arms 11 and 12 are two free end portions for dispensing the shoe covers 90. As shown in FIGS. 11I to 11L of the drawings, when the locking assembly 30 is operated to lock the two second end portions 102 of the installation arms 11 and 12, the two first end portions 101 of the installation arms 11 and 12 are released for installing new shoe covers 90 to the installation arms 11 and 12.

The operation of the second locking member 32 for locking the two second end portions 102 of the installation arms 11 and 12 will automatically drive the first locking member 31 to release the two first end portions 101 of the installation arms 11 and 12. The operation of the first locking member 31 for locking the two first end portions 101 of the installation arms 11 and 12 will automatically drive the second locking member 32 to release the two second end portions 102 of the installation arms 11 and 12.

According to this fourth alternative mode of the preferred embodiment of the present invention, the first locking member 31 comprises the positioning member 312, the first positioning block 313 and the second positioning block 314. The first positioning block 313 and the second positioning block 314 are substantially W-shaped members, wherein the two first end portions 101 of the two installation arms 11 and 12 of the installation assembly 10 can be respectively stored in the grooves 310 of the first positioning block 313 and the second positioning block 314. Each of the first positioning block 313 and the second positioning block 314 has a clamping groove 315 for retaining the positioning member 312.

The second locking member 32 comprises two locking system 320 each comprises the guiding mechanism 327, the locking unit 328, and the transmission mechanism 329. The first locking member 31 is integrated with the two cranks 3291 of the transmission mechanism 329 to form the cover frame 3293, so that when the cover frame 3293 is rotated upward, the positioning member 312 is rotated to release the two first end portions 101 of the installation arms 11 and 12, while simultaneously the two second end portions 102 of the installation arms 11 and 12 are driven to be pushed by the pusher members 32722 because of linkage of the second locking member 31 with the first locking member 31, so as to be locked by the locking unit 328, as shown in FIGS. 11I to 11L of the drawings.

When the two first end portions 101 of the installation arms 11 and 12 are free end portions and finished the replacement of new cover covers 90 which are installed on the installation arms 11 and 12, the cover frame 3293 can be rotated downward, so that the two first end portions 101 of the installation arms 11 and 12 are pushed by the positioning member 312, so as to be locked at the grooves 310. Simultaneously, the cover frame 3293 drive the transmission mechanism 329 to move, so as to drive the guide mechanism 327 to drive the two pusher members 32722 to rotate away from the two second end portions 102 of the installation arms 11 and 12, so as to release the two second end portions 102 of the installation arms 11 and 12 to allow the two second end portions 102 of the installation arms 11 and 12 to function as free end portions for dispensing the shoe covers 90. As shown in FIGS. 12A to 12H which illustrate a preferred embodiment shoe cover dispenser device 100 according to a fifth alternative mode of the preferred embodiment of the present invention. In this fifth alternative mode of the preferred embodiment of the present invention, the second locking member 32 is configured to comprise two self-locking assemblies 325 each comprises a self-locking body 3251 and a self-locking member 3252, wherein the self-locking body 3251 has a receiving groove 3250, the receiving groove 3250 can receive one of the installation arms 11, 12, the self-locking member 3252 is movably arranged on an upper part of the receiving groove 3250 of the self-locking body 3251. When the installation arm 11, 12 are pushed into the two receiving grooves 3250, the two self-locking members 3252 can block the installation arm 11, 12 from moving out from the receiving grooves 3250, thereby fixing the installation arm 11, 12 in the receiving grooves 3250 of the self-locking assembly 30.

Referring to FIGS. 12A-12H, the self-locking assembly 325 further comprises a reset member 3253, wherein the reset member 3253 is elastically disposed on the self-locking body 3251 and the reset member 3253 is coupled with the self-locking member 3252, so that the self-locking member 3252 is retained by the reset member 3253 and outward movement of the self-locking member 3252 is blocked. When the installation arms 11 and 12 are respectively pushed into the receiving grooves 3250, the self-locking members 3252 can rotate with the displacement of the installation arms 11 and 12 to allow the installation arms 11 and 12 to enter the receiving grooves 3250, after the installation arms 11 and 12 are respectively disposed in the receiving grooves 3250, the two self-locking members 3252 rotate back to its initial positions, but further movement is blocked by the reset member 3253.

When the installation arms 11 and 12 need to be released from the receiving grooves 3250 of the self-locking assembly 30, it is only necessary to push the reset member 3253 away from the self-locking member 3252, so that the self-locking member 3252 can realize reverse rotation, so that the installation arms 11 and 12 can push the self-locking members 3252 to rotate in a reverse direction to escape from the receiving grooves 3250.

Figure 13A:
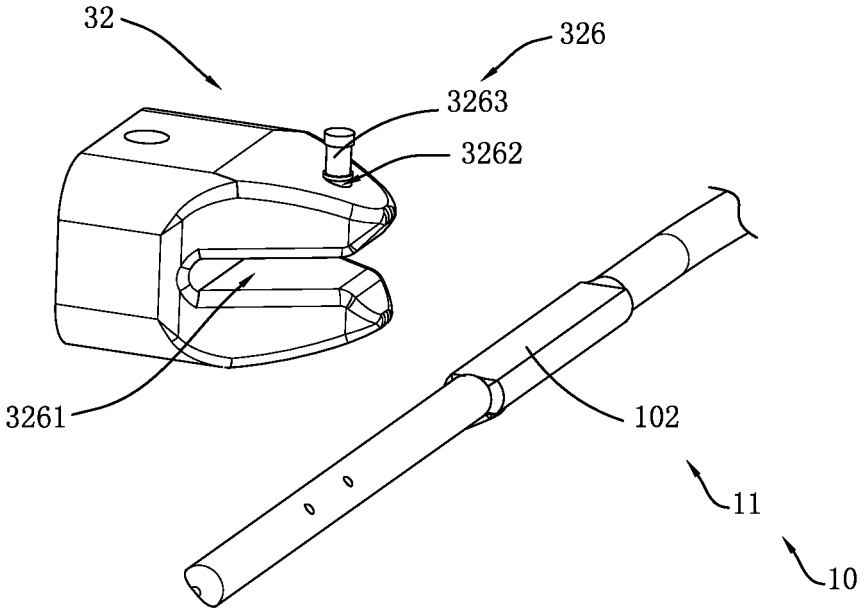
FIGS. 13A and 13B are enlarged perspective views illustrating a second locking member of the shoe cover dispenser device according to a sixth alternative mode of the preferred embodiment of the present invention.
Figure 13B:
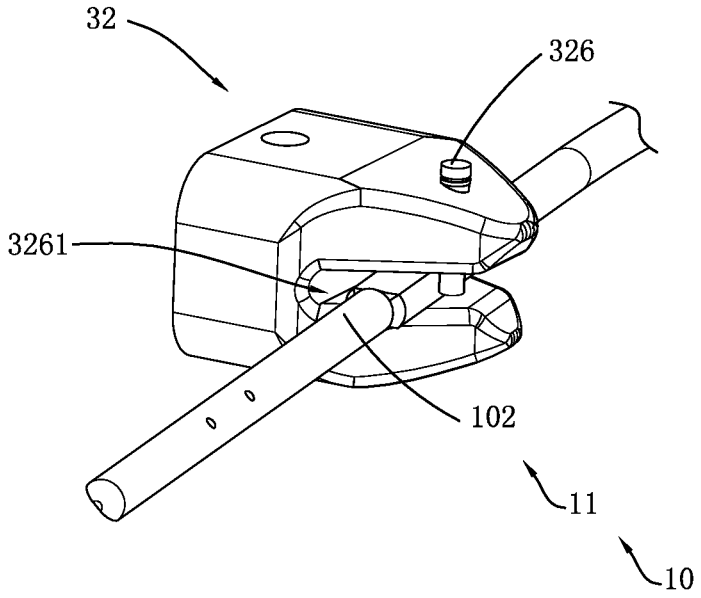

As shown in FIGS. 13A to 13B, the shoe cover dispenser device 100 according to a sixth alternative mode of the preferred embodiment of the present invention is illustrated. The difference from the above-mentioned preferred embodiment is that in this sixth alternative mode, the second locking member 32 is implemented to comprise two elastic locking sleeves 326, and each elastic locking sleeves 326 has an engaging groove 3261, a mounting hole 3262 and an elastic lock 3263, the mounting hole 3262 is provided in the housing of the elastic locking sleeves 326 and located on an upper outside of the engaging groove 3261, the elastic lock 3263 is elastically mounted in the mounting hole 3262 and can be pushed up and down with respect to the mounting hole 3262 to lock or release one of the second end portions 102 of the installation arm 11 and 12 through the engaging groove 3261.

The size of the engaging groove 3261 is set to enable each of the second end portions 102 of the installation arms 11 and 12 to be received in the engaging grooves 3261, and when the second end portions 102 of the installation arms 11 and 12 are respectively received in the engaging grooves 3261. The installer may press the elastic lock 3263 to penetrate the mounting hole 3262 to allow the elastic lock 3263 to be extended into the engaging groove 3261, thereby blocking the second end portions 102 of the installation arms 11 and 12 from moving out of the engaging grooves 326, so as to lock the second end portions 102 of the installation arms 11 and 12.

Figure 14A:
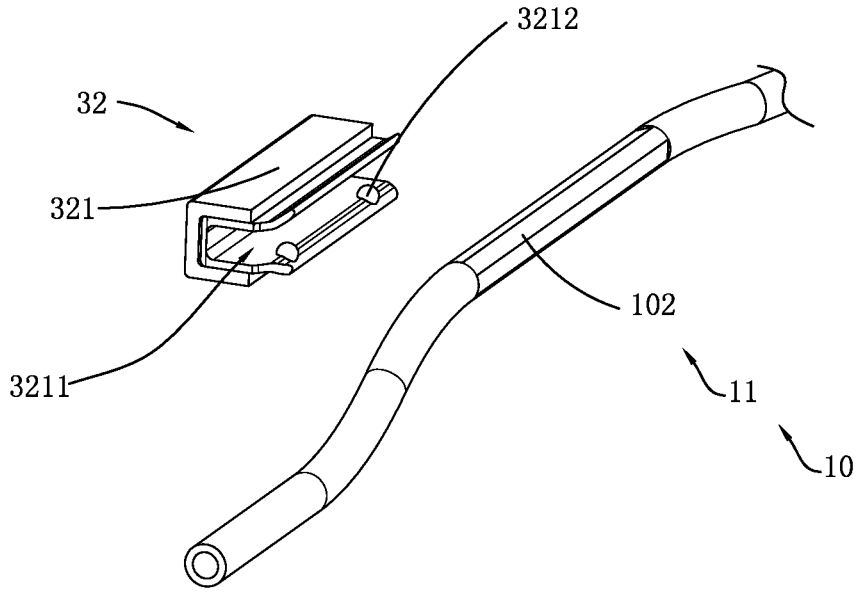
FIGS. 14A and 14B are perspective views illustrating a second locking member of the shoe cover dispenser device according to another alternative mode of the preferred embodiment of the present invention.
Figure 14B:
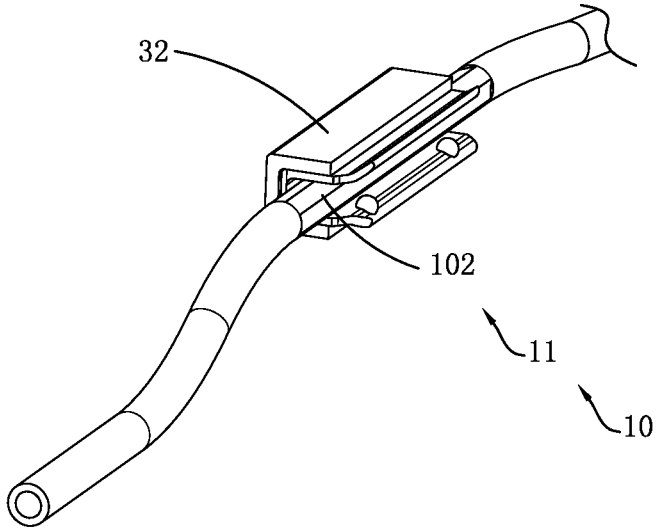

In addition, those skilled in the art can determine or change the specific structure of the second locking member 32 according to the actual situation, as shown in FIG. 14A and FIG. 14B, such as changing the first holding member 321 and the second holding member 322 And/or change the shape, the position or the quantity of the first locking ball 341 and/or the second locking ball 342. In other words, as long as the same or similar technical solutions as the present invention are adopted on the basis of the above disclosure of the present invention, the same or similar technical problems as the present invention are solved, and the same or similar technical effects as the present invention are achieved. All of them fall within the protection scope of the present invention, and the specific embodiments of the present invention are not limited thereto.

Figure 15A:
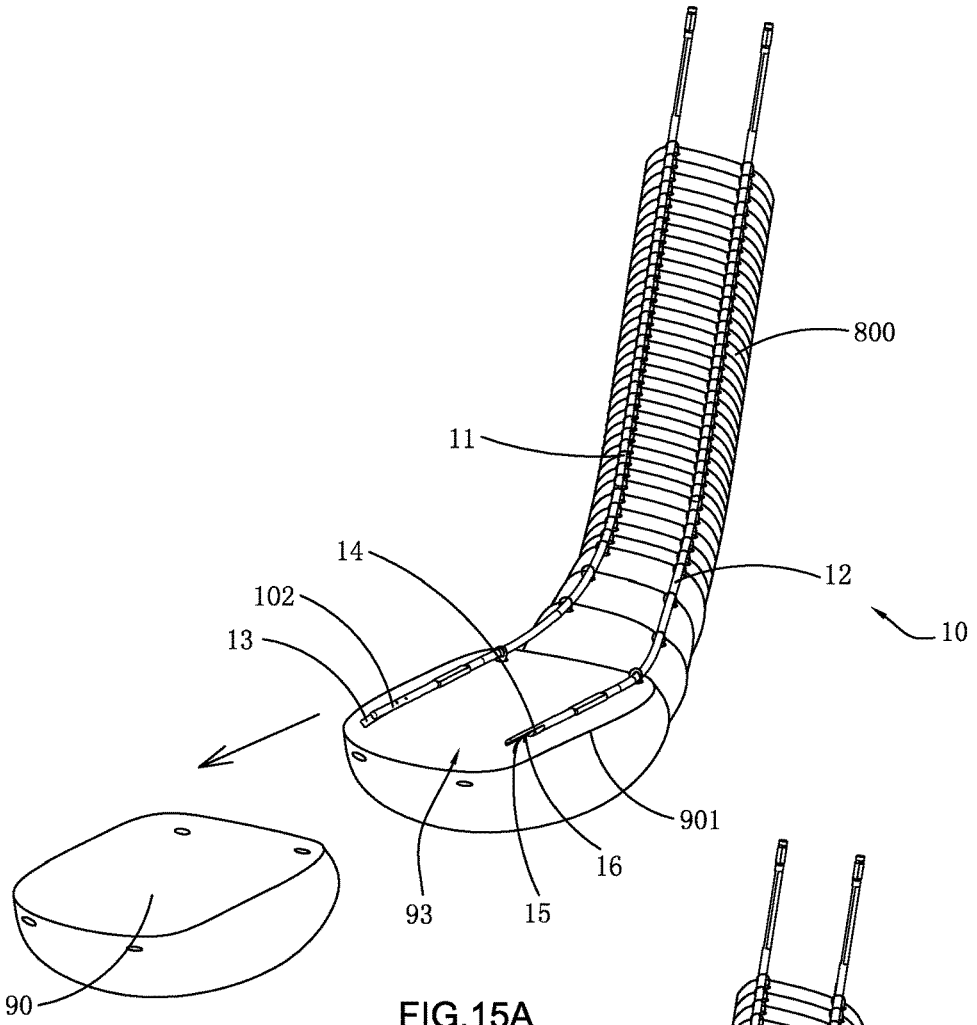
FIGS. 15A to 15B are perspective views illustrating the shoe cover dispenser device dispensing the shoe covers according to the preferred embodiment of the present invention.
Figure 15B:
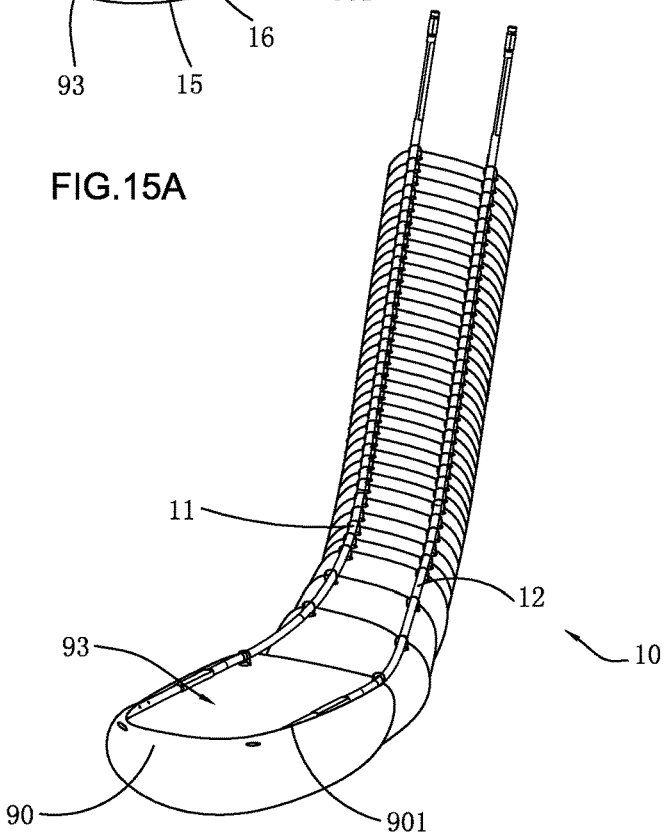
Figure 15C:
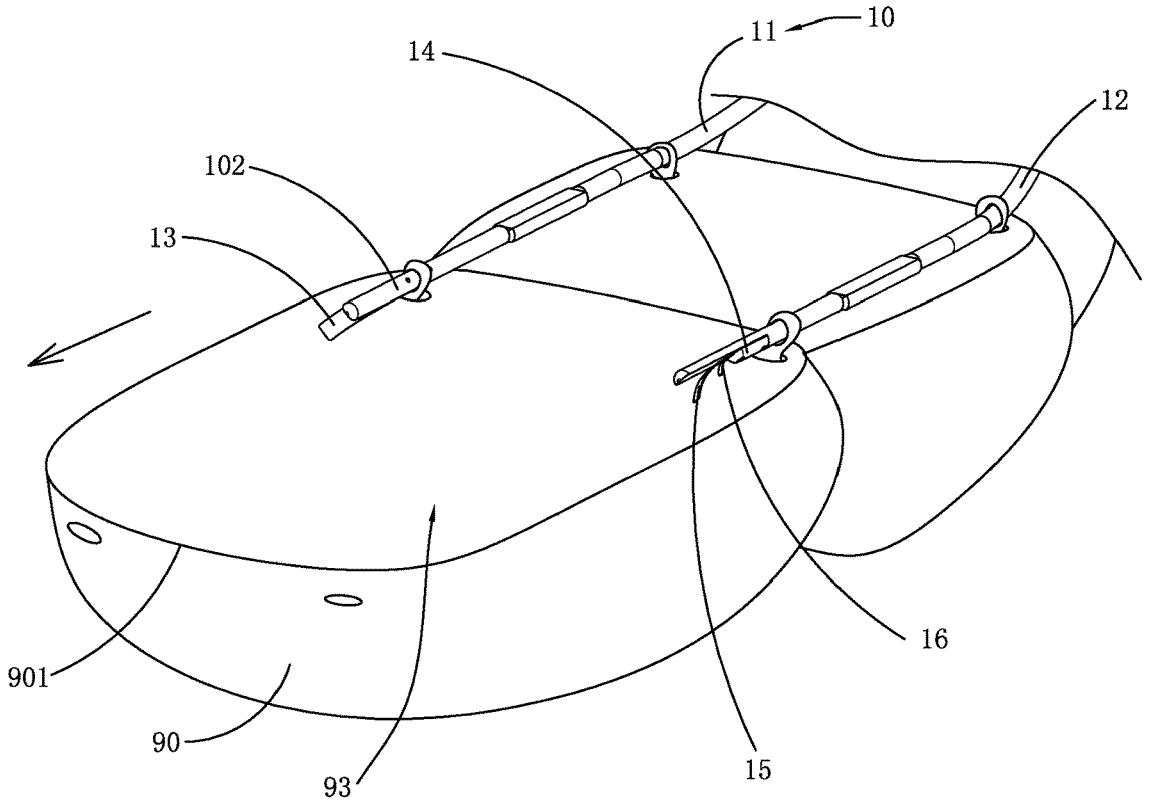
FIG. 15C is an enlarged perspective view illustrating the shoe covers according to the preferred embodiment of the present invention.

As shown in FIGS. 15A to 15C, in the preferred embodiment of the of the present invention, the installation assembly 10 further comprises at least two stoppers 13 and 14, and the two stoppers 13 and 14 are respectively mounted on ends of the second end portions 102 of the two installation arms 11 and 12 to prevent a subsequent shoe cover 90 from retracting backward under the action of elastic force after a standby shoe cover 90 is taken out.

Since the front and rear shoe covers 90 are interlocked with each other, when a standby shoe cover 90 is worn by a user, the subsequent shoe cover 90 will move forward. After the standby shoe cover 90 is separated from the subsequent shoe cover 90, the subsequent shoe cover 90 shrinks backward under the action of its elastic opening edge 901. When encountering the stoppers 13 and 14, a front end portion of the subsequent shoe cover 90 is blocked by the stoppers 13 and 14 to avoid further retract movement. At the same time, since a rear end portion of the subsequent shoe cover 90 is pulled by a rear shoe cover 90, under the action of the stoppers 13 and 14, the subsequent shoe cover 90 is in an open state and function as a subsequent standby shoe cover 90 for the user to wear on.

Figure 15D:
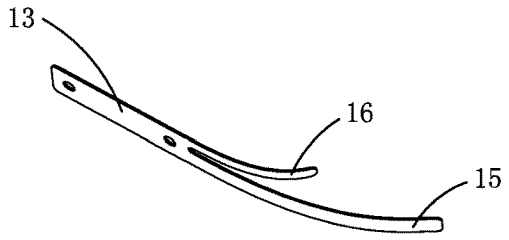
FIGS. 15D and 15E are enlarged perspective views illustrating a stopper of the the shoe cover dispenser device according to the preferred embodiment of the present invention

As shown in FIG. 15D, each of the stoppers 13 and 14 is formed as an arc-shaped arm for retaining the front end portion of the subsequent shoe cover 90.

Figure 15E:
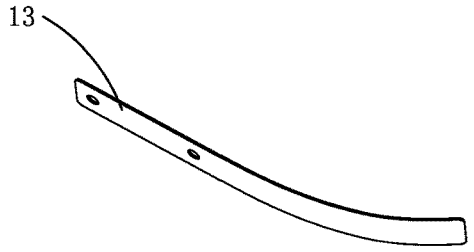

As shown in FIG. 15E, each of the stoppers 13 and 14 comprises a first stopper end portion 15 and a second stopper end portion 16, wherein each of the first stopper end portion 15 and the second stopper end portion 16 is extended inwardly and formed in an arc shape, the lengths of the first stopper end portion 15 and the second stopper end portion 16 are not the same. The front end portion of the subsequent shoe cover 90 is either retained by the first stopper end portion 15, or the second stopper end portion 16, or is retained between the first stopper end portion 15 and the second stopper end portion 16, so as to ensure that the subsequent shoe cover 90 is retained at the second end portions 102 of the installation arms 11 and 12 with enlarged opening 93 ready for a user to put his or her shoe into the subsequent shoe cover 90 which function as a next standby shoe cover 90 ready for use.

In other words, the length of the first stopper end portion 15 of each of the stoppers 13 and 14 is longer than the length of the second stopper end portion 16, and the first stopper end portion 15 is located on the front side of the second stopper end portion 16, so that when the rear shoe cover 90 detached from the front shoe cover, under the action of retracting elastic tension of the elastic opening edge 901 of the rear shoe cover 90, the retraction of the front end portion of the rear shoe cover 90 is first blocked by the first stopper end portion 15. If the first stopper end portion 15 does not block the backward movement of the shoe cover 90, the shoe cover 90 will encounter the second stopper end portion 16 for blocking the further retraction.

Figure 16A:
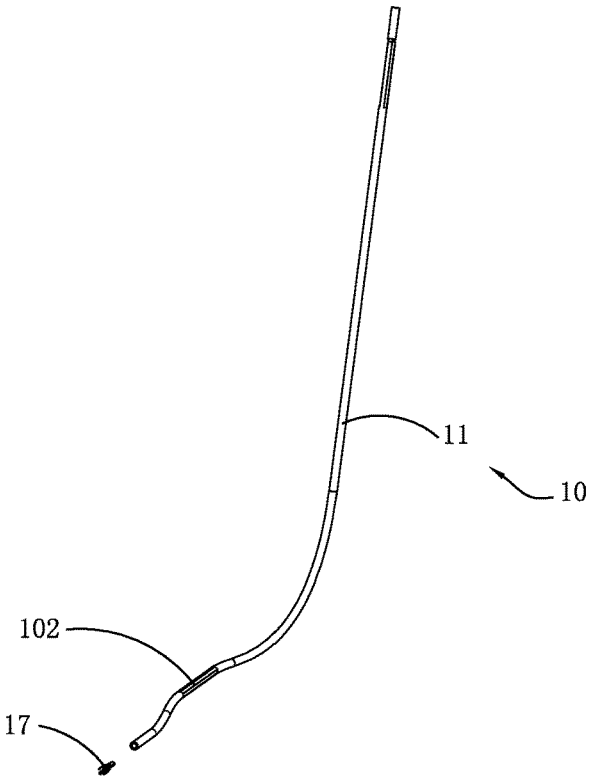
FIGS. 16A to 16C are enlarged perspective views illustrating stoppers the shoe cover dispenser device according to an seventh alternative mode of the preferred embodiment of the present invention.
Figure 16B:
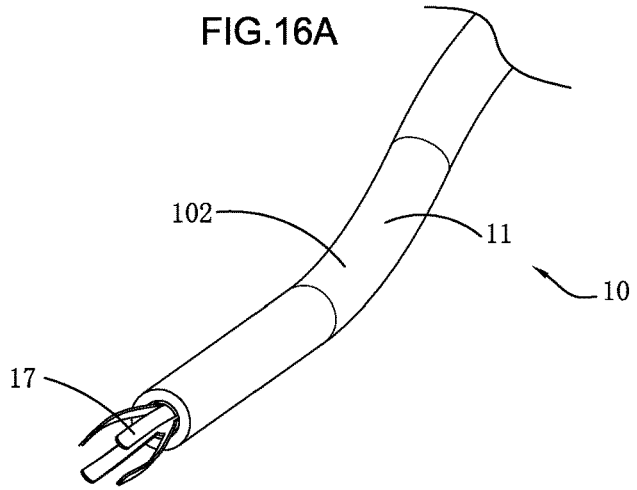
Figure 16C:
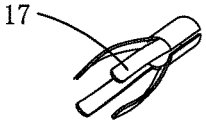

As shown in FIGS. 16A to 16C, the shoe cover dispenser device 100 according to a seventh alternative mode of the preferred embodiment of the present invention is illustrated. The difference from the above-mentioned preferred embodiment is that in this seventh alternative mode, each of the stoppers 13 and 14 comprises a plurality of stopper claws 17, and the plurality of stopper claws 17 are along a circumferential direction so that when the front standby shoe cover 90 is pulled away from the two installation arms 11 and 12 of the installation assembly 10, the front end portion of the rear subsequent shoe cover 90 can be retained by the stopper claws 17 to prevent the front end portion of the rear subsequent shoe cover 90 from retracting, so as to make the rear shoe cover 90 be in an open state under the action of the stopper claws 17.

Figure 16D:
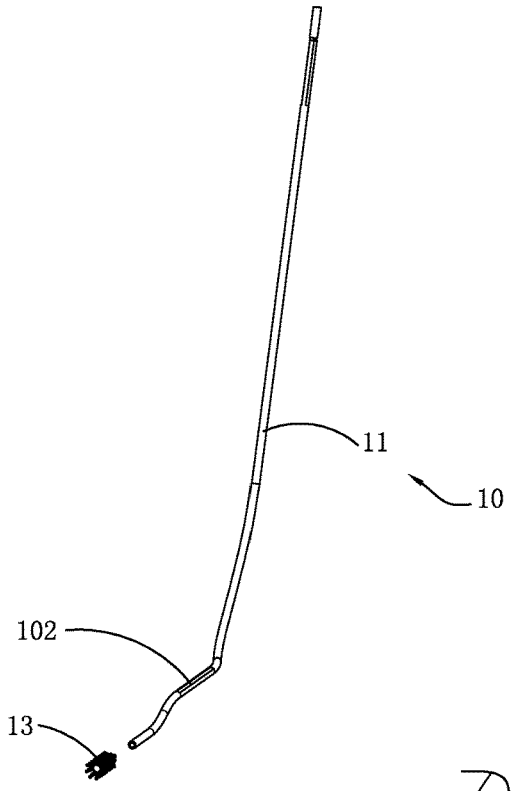
FIGS. 16D to 16F are enlarged perspective views illustrating stoppers of the shoe cover dispenser device according to an eighth alternative mode of the preferred embodiment of the present invention
Figure 16E:
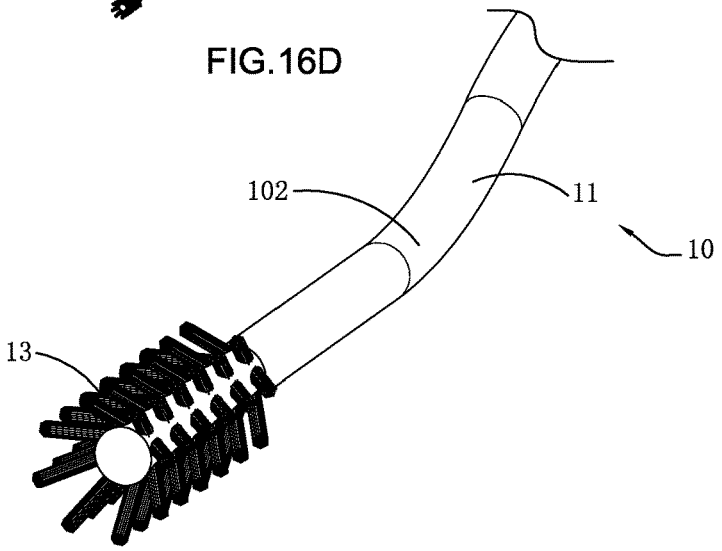
Figure 16F:
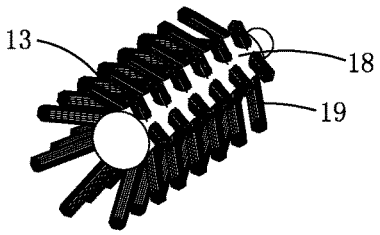

As shown in FIGS. 16D to 16F, the cover dispenser device 100 according to an eighth alternative mode of the preferred embodiment of the present invention is illustrated. The difference from the above-mentioned preferred embodiment is that in this eighth alternative mode, each of the stoppers 13 and 14 comprises a stopper head body 18, and a plurality of stopper protrusions 19 extended from the stopper head body 18, so that after the front standby shoe cover 90 is taken out, the stoppers 13 and 14 can prevent the rear subsequent shoe cover 90 from retracting from multiple angles, and can make the rear subsequent shoe cover 90 be in an open state under the action of the stoppers 13 and 14.

As shown in FIGS. 1 to 16F of the drawings, the frame 20 has a L-shaped configuration and each of the two installation arms 11 and 12 of the installation assembly 10 may comprise a downward curved portion and a horizontal portion. The downward curved portion and the horizontal portion are integrated with each other, or two portions that are assembled with each other.

Figure 17A:
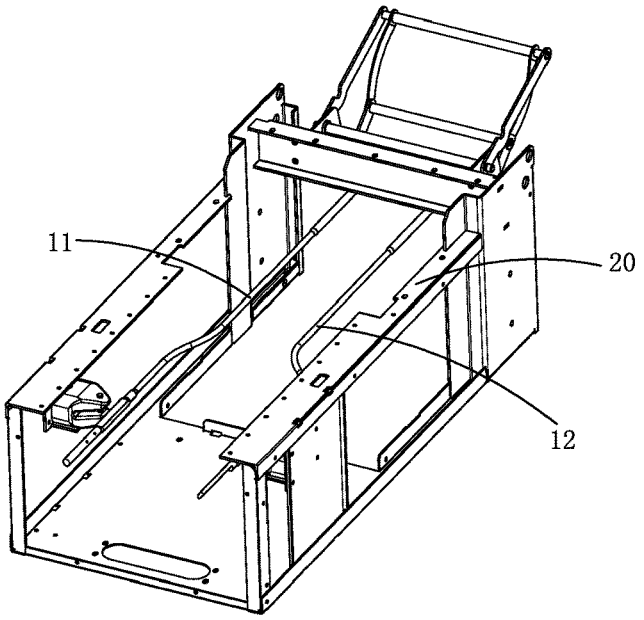
FIGS. 17A to 17C are perspective views of the shoe cover dispenser device according to a ninth alternative mode of the preferred embodiment of the present invention.
Figure 17B:
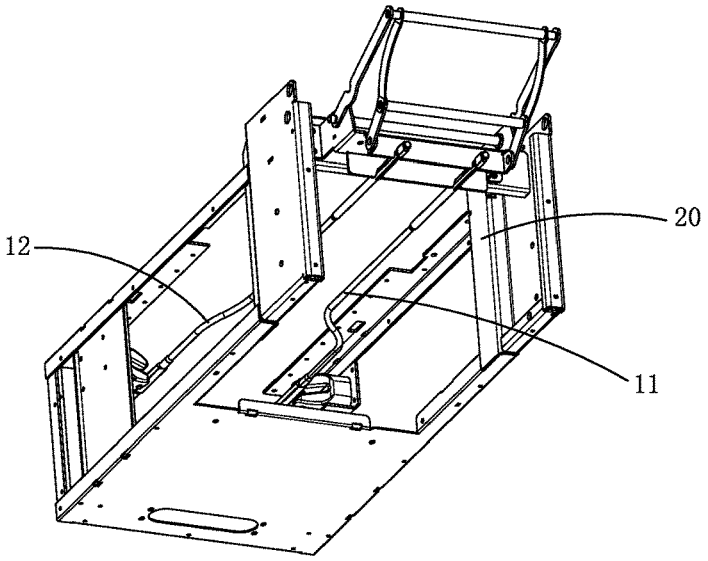
Figure 17C:
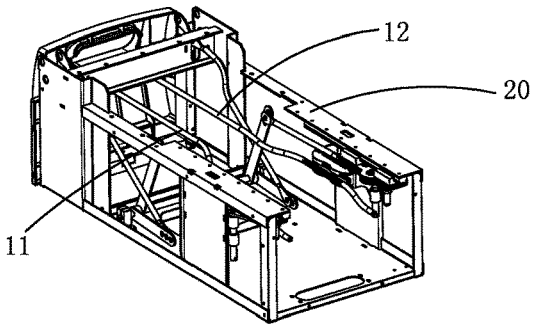

FIGS. 17A to 17C, the shoe cover dispenser device 100 according to a ninth alternative mode of the preferred embodiment of the present invention is illustrated. The difference from the above-mentioned preferred embodiment is that in this ninth alternative mode, the frame 20 is arranged horizontally, and the installation assembly 10 is also arranged horizontally, so that a plurality of the shoe covers 90 are installed horizontally on the two installation arms 11 and 12 of the installation assembly 10, and when the user uses them, a plurality of the shoe covers 90 moves in the horizontal direction and are used in sequence.

The difference from the above-mentioned preferred embodiment is that in the ninth alternative mode, since the frame 20 is horizontally arranged, it has a regular structure as a whole and saves a certain amount of space in height. Therefore, the use of the frame 20 in the ninth alternative mode can facilitate the packaging and transportation of the shoe cover dispenser device 100, and can also save the space for using the shoe cover dispenser device 100.

The present invention further provides a shoe cover assembly 800. The shoe cover assembly 800 comprises a plurality of shoe covers 90. The plurality of shoe covers 90 are connected in series and the adjacent shoe covers 90 are removable connected to each other.

Figure 18:
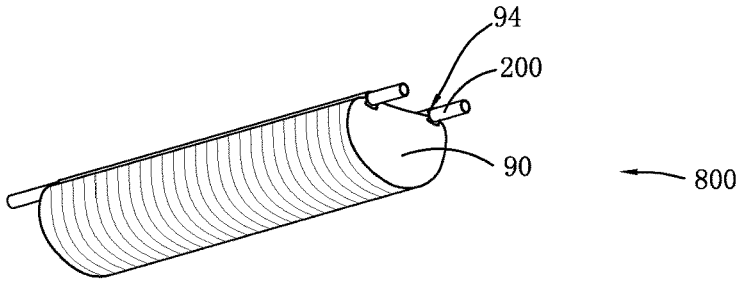
FIG. 18 is perspective view of a shoe cover assembly according to the preferred embodiment of the present invention.
Figure 19:
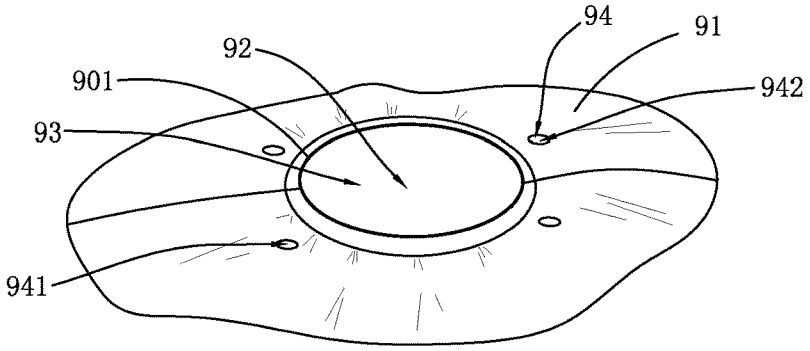
FIG. 19 is an enlarged perspective view of a single shoe cover according to the preferred embodiment of the present invention.
Figure 20A:
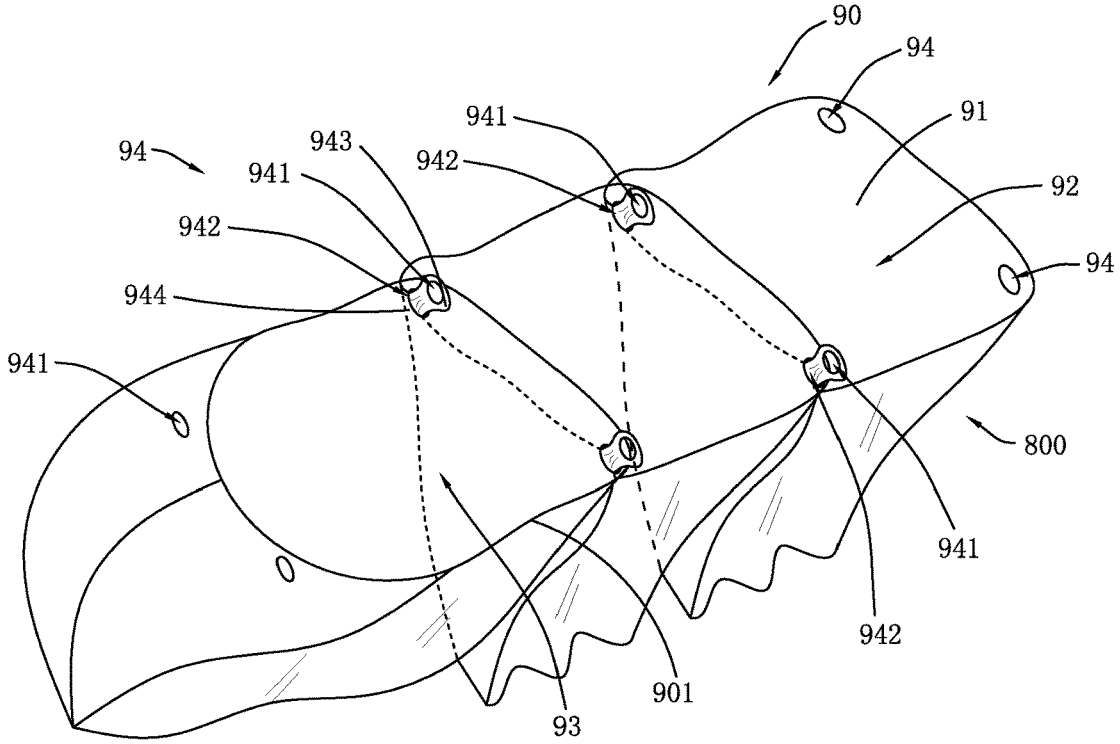
FIGS. 20A and 20B are perspective views illustrating the joined connection between shoe covers of the shoe cover assembly according to the preferred embodiment of the present invention
Figure 20B:
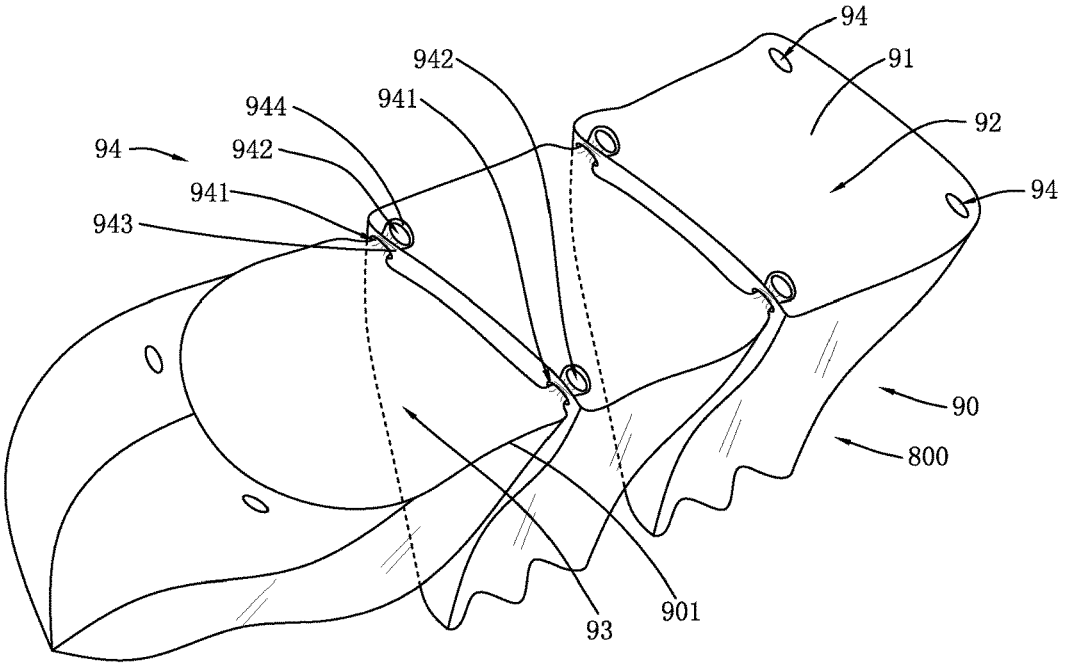

As shown in FIGS. 18 to 20, in the preferred embodiment of the shoe cover assembly 800 of the present invention, the shoe cover assembly 800 comprises a plurality of shoe covers 90. Before the plurality of shoe covers 90 are assembled and installed on the two installation arms 11 and 12, two connecting rods 200 can be arranged for connecting the plurality of shoe covers 90.

Each of the shoe covers 90 comprises a shoe cover main body 91 having a receiving cavity 92 and an elastic opening edge 901 defining the opening 93, the opening 93 is arranged on the upper part of the shoe cover main body 91 so that the user's shoe can extend into the receiving cavity 92 of the shoe cover main body 91 through the opening 93.

As shown in FIGS. 19 to 20, the shoe cover main body 91 is provided with four joint perforations 94, and the four joint perforations 94 are formed in the shoe cover main body 91 which defines the receiving cavity 92. The four joint perforations 94 are divided into two front joint perforations 941 formed in two front perforation portions 943 and two rear joint perforations 942 formed in two rear perforation portions 944. The front perforation portions 943 and the rear perforation portions 944 are integral parts of the shoe cove main body 91 defining the boundaries of the joint perforations 941 and 942.

As shown in FIG. 20, each row of two front perforation portions 943 of a rear shoe cover 90 pass through a row of two rear joint perforations 942 of an adjacent front shoe cover to expose the row of two front joint perforations 941 each of the connecting rods 200 to pass through the front joint perforations 941, so that a plurality of the shoe covers 90 are connected and joined by the two connecting rods 200 in series.

Accordingly, the installation of the shoe covers 90 on the two connecting rods 20 only requires the two connecting rods 200 to pass through the rows of the front joint perforations 941, but not require to pass through the row of rear joint perforations 942, so that the installation of the shoe coves on the two connecting rods 200 is simplified.

In the preferred embodiment of the shoe cover assembly 800 of the present invention, the two connecting rods 200 are respectively flexible hollow tubular rods. When the shoe cover assembly 800 is installed on the shoe cover dispenser device 100, the two connecting rods 200 are inserted with the two installation arms 11 and 12 of the installation assembly 10 of the shoe cover dispenser device 100, and then the two connecting rods 200 are pulled out to leave the plurality of shoe covers 90 on the installation arms 11 and 12 of the shoe cover dispenser device 100.

Since the two connecting rods 200 are respectively flexible hollow tubes, it is convenient to match the shape and structure of the two installation arms 11, 12 of the shoe cover device during the installation of the shoe cover assembly 800. In addition, since the two connecting rods 200 respectively penetrate through the rear joint perforations 942 in the plurality of shoe covers 90 in sequence, when the plurality of shoe covers 90 are installed on the installation arms 11, 12, the two connecting rods 200 are easy to be removed from the installation arms 11, 12.

In detail, as a modification of the preferred embodiment of the shoe cover assembly 800 of the present invention, in the shoe cover assembly 800, the connection mode of the two front and rear shoe covers 90 is changed to the following manner that the rear perforation portions 944 of a front shoe cover 90 pass through the front joint perforations 941 of a rear shoe cover 90 and the two connecting rods 200 pass through the rear joint perforations 942 to allow the plurality of shoe covers be slidable along the two connecting rods 200.

Next, the installation process and working principle of the shoe cover assembly 800 and shoe cover dispenser device 100 of the present invention will be further briefly described referring to FIGS. 21A to 21H.

Figure 21A:
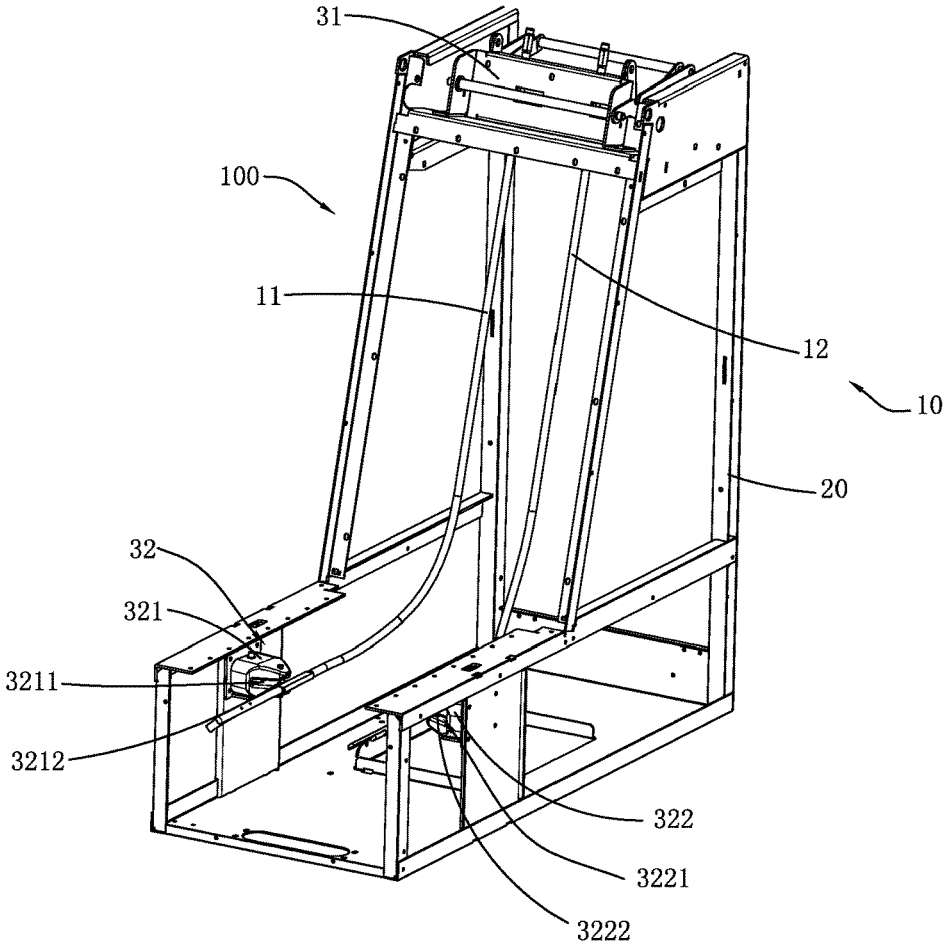
FIGS. 21A to 21D are perspective views illustrating the installation of the shoe cover assembly on the shoe cover dispenser device according to the preferred embodiment of the present invention.
Figure 21B:
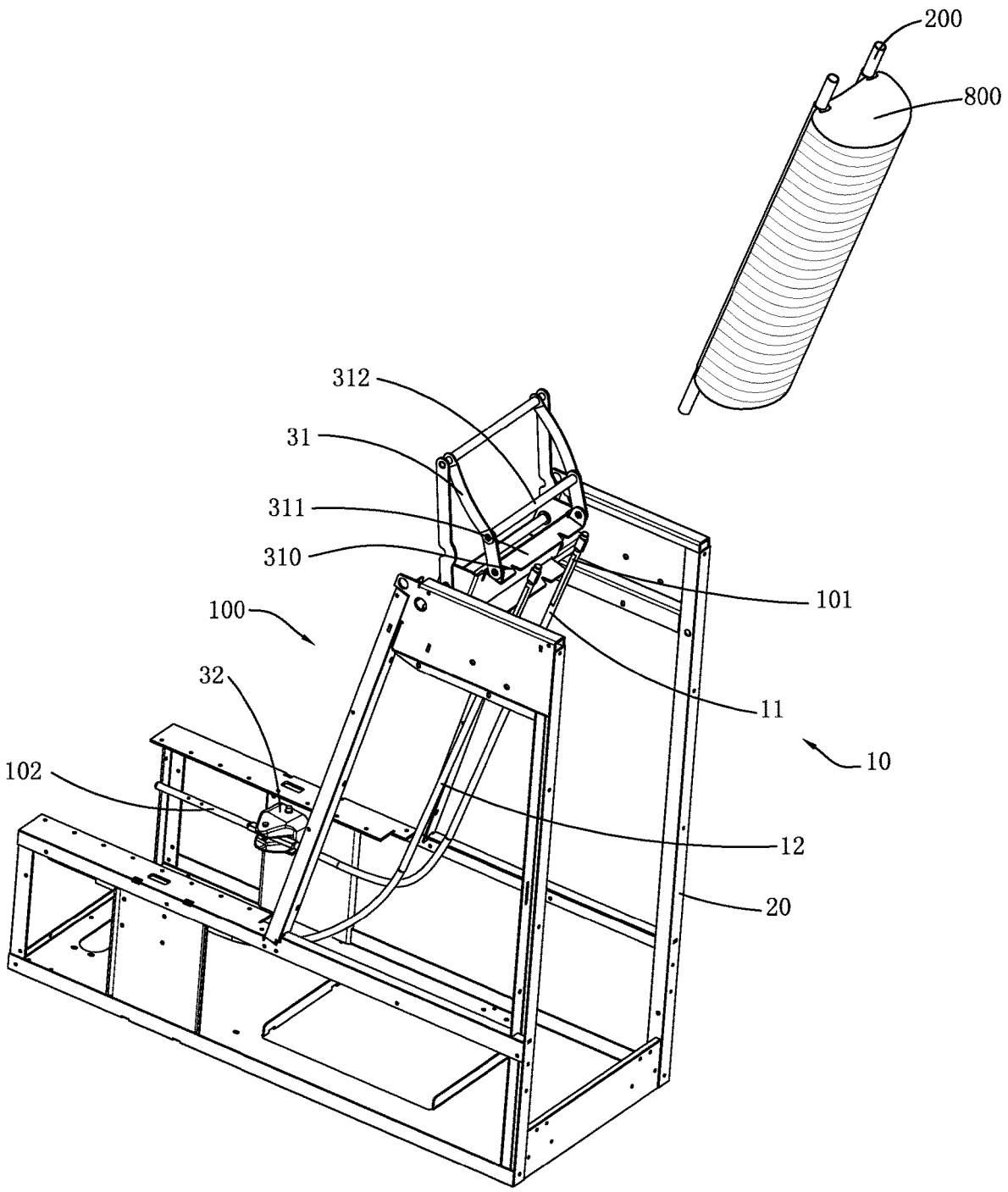
Figure 21C:
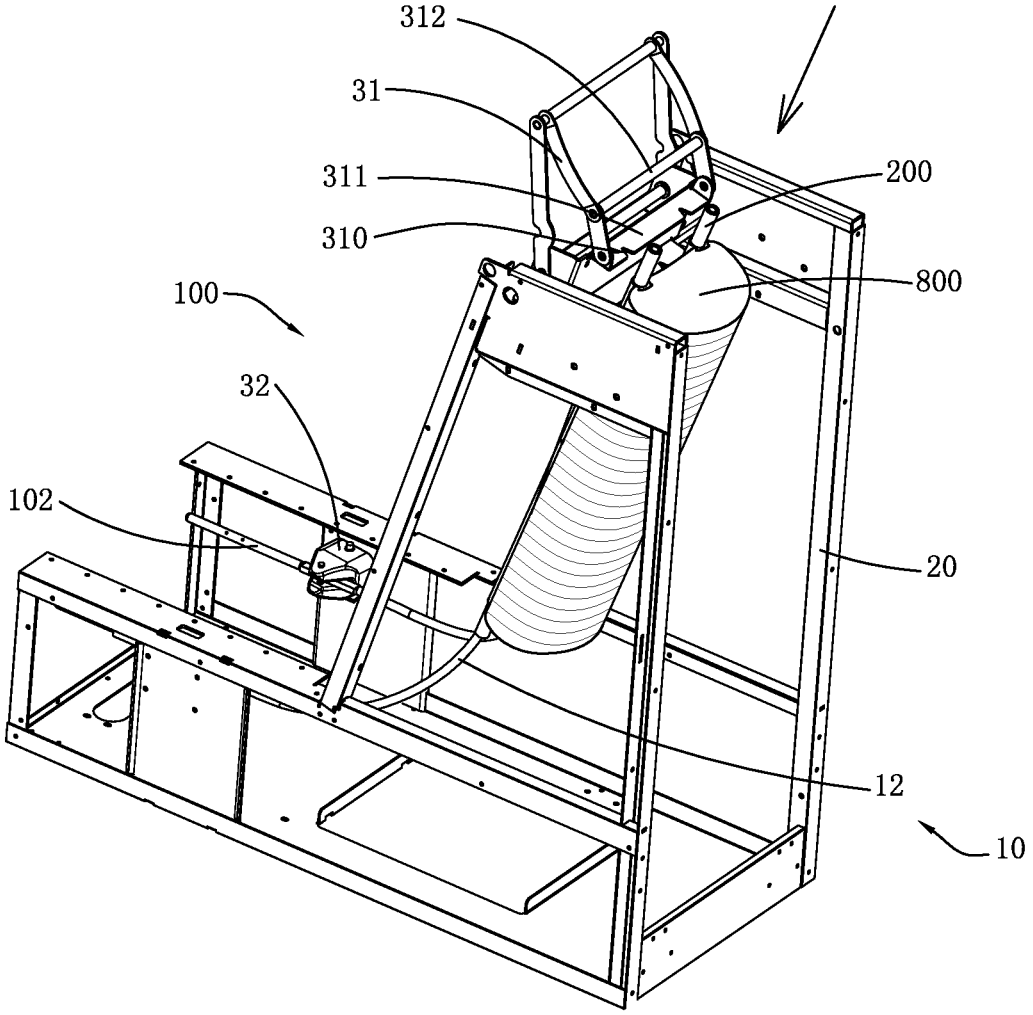
Figure 21D:
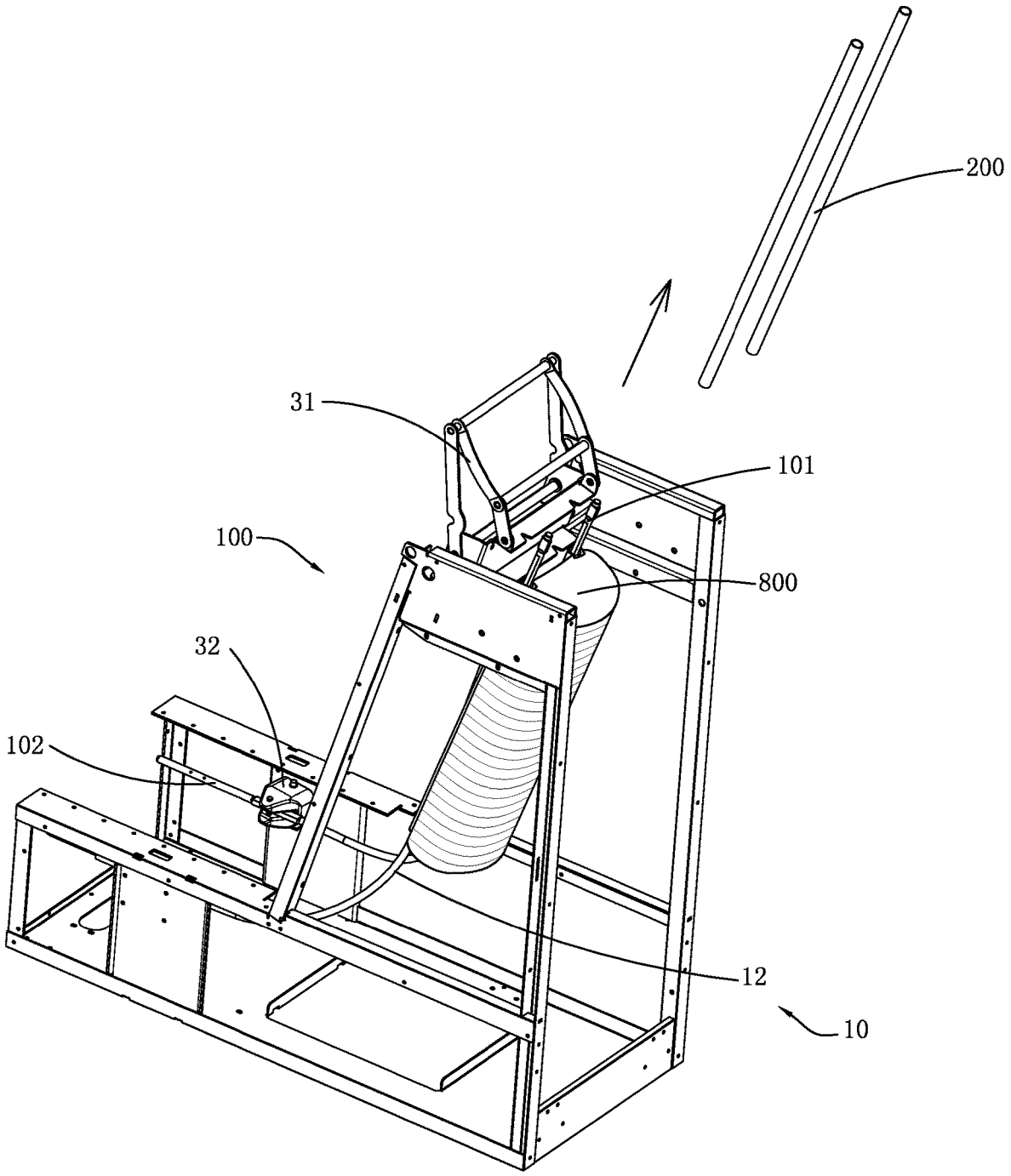

As shown in FIG. 21A, the two second end portions 102 are free end portions while the two first end portions 101 are locked by the first locking member 31. As shown in FIGS. 21B to 21D, the two second end portions 102 of the two installation arms 11 and 12 are first locked by the second locking member 32, so that the two installation arms 11 and 12 are fixed to the frame 20 of the shoe cover dispenser device 100, then the two first end portions 101 of the two installation arms 11 and 12 are released from the first locking member 31 to become free end portions.

Then connect the two connecting rods 200 of the shoe cover assembly 800 with the two installation arms 11 and 12 of the shoe cover dispenser device 100, and install the shoe covers 90 to the installation arms 11 and 12, and then remove the two connecting rods 20 to leave the plurality of shoe covers 90 on the two installation arms.

Figure 21E:
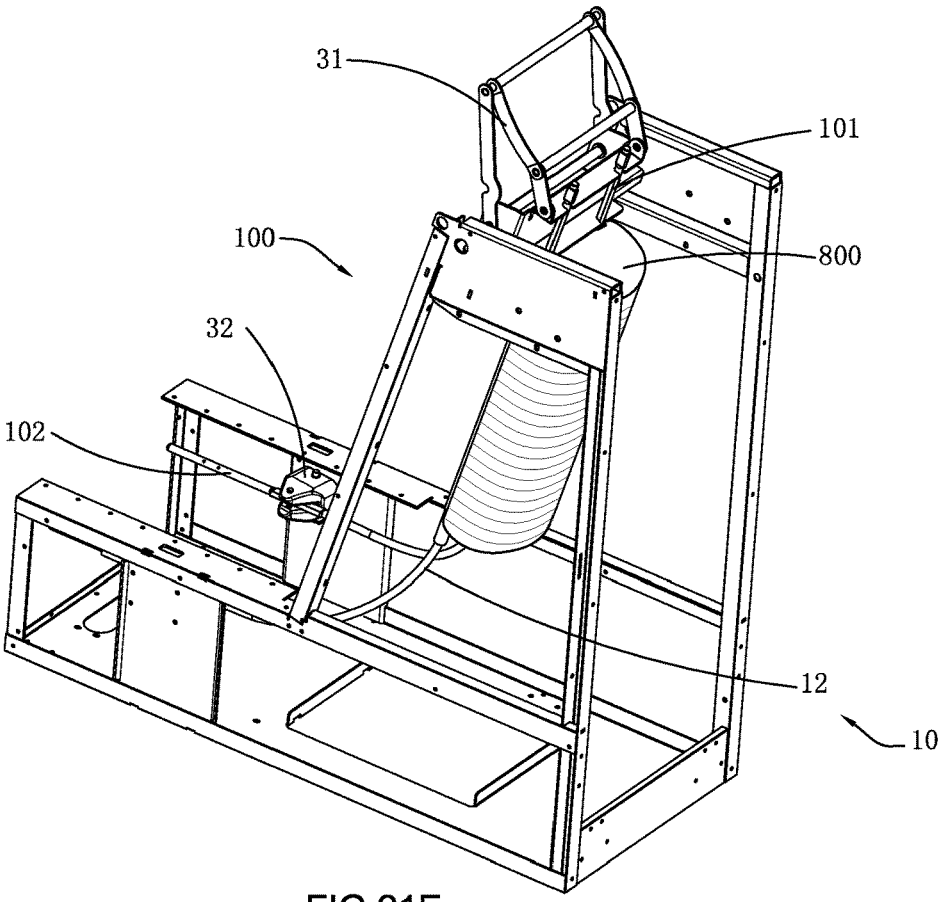
FIGS. 21E to 21H are perspective views illustrating the locking of the first end portion of the two installation arms by the first locking member and releasing of the second end portions of the two installation arms by the second locking member to prepare the shoe covers ready for dispensing through the shoe cover dispenser device according to the preferred embodiment of the present invention.
Figure 21F:
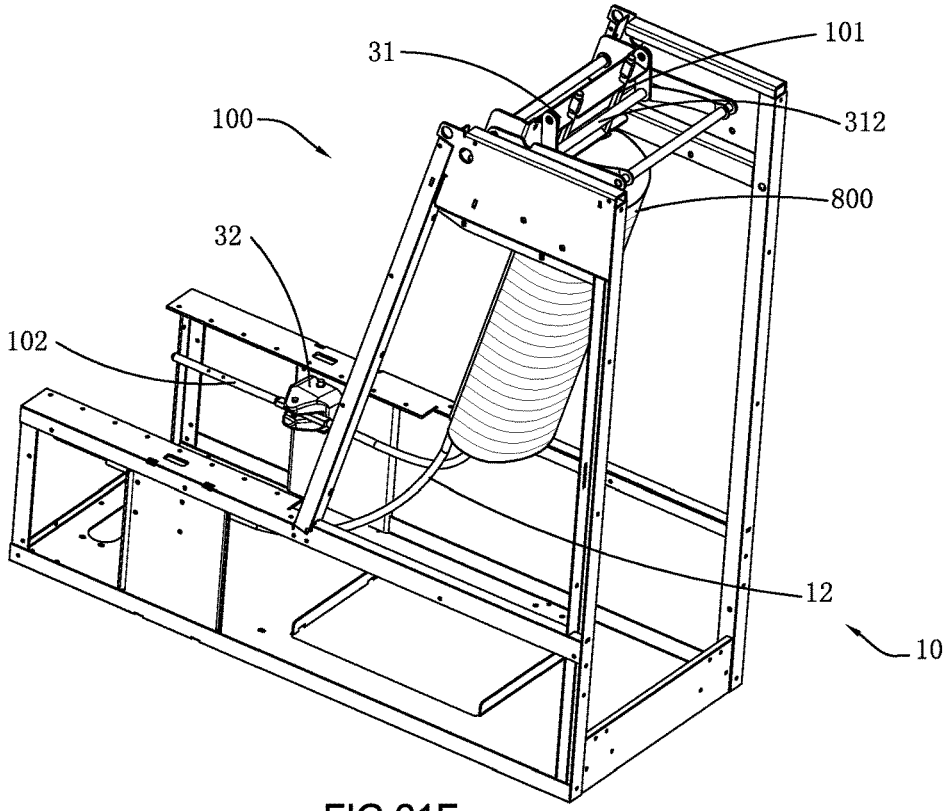
Figure 21G:
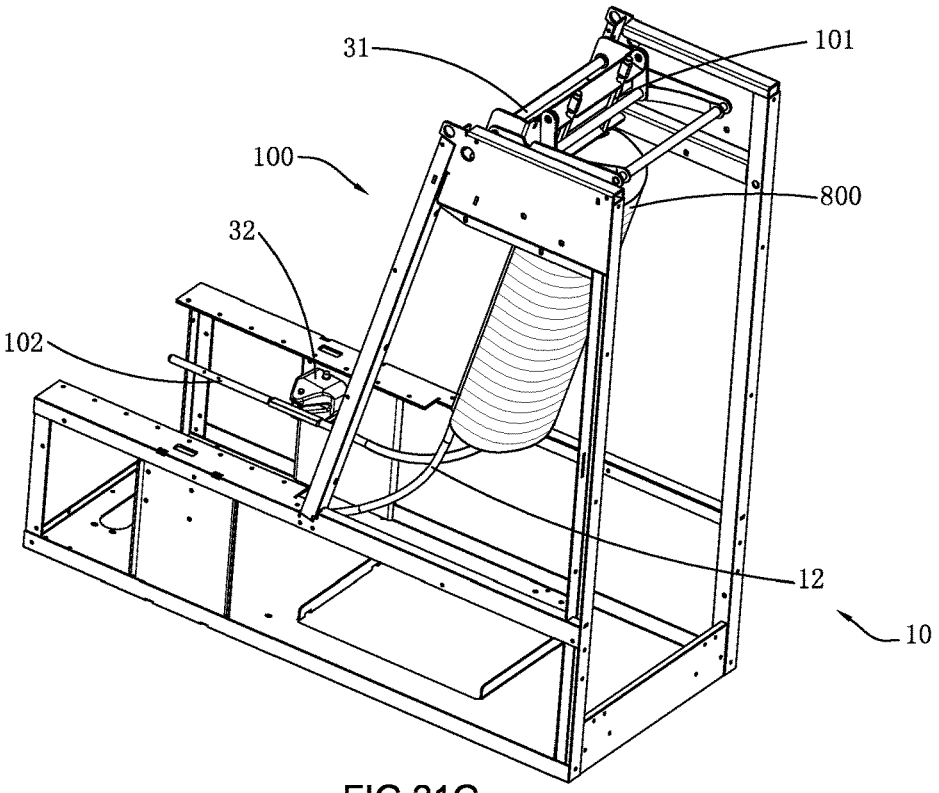
Figure 21H:
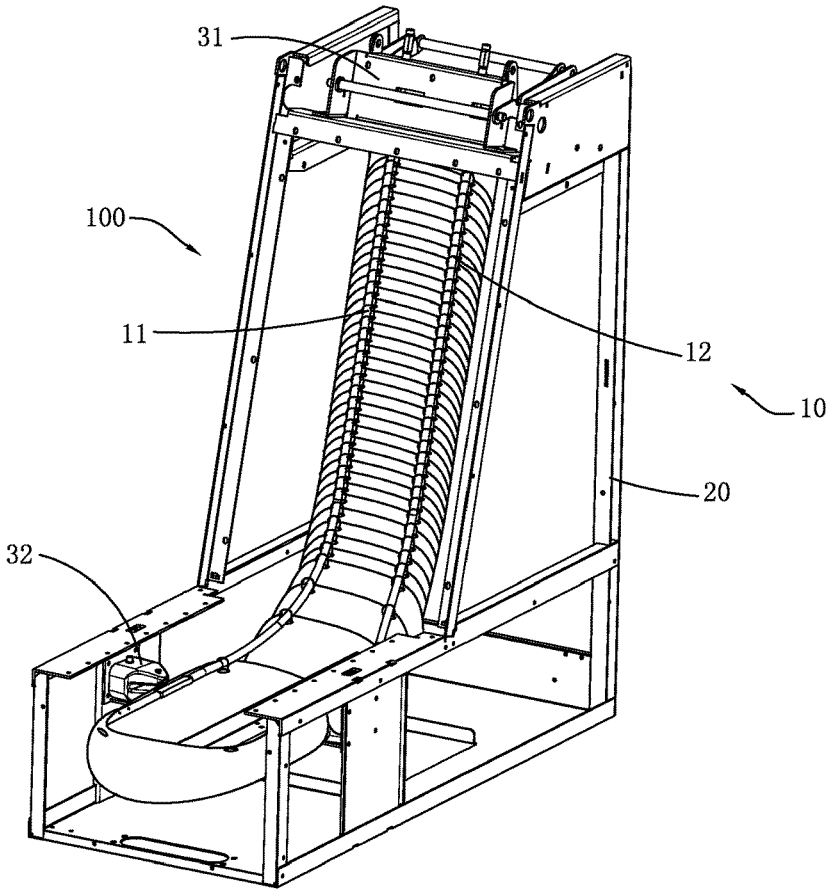

Afterwards, as shown in FIGS. 21E and 21F, the two first end portions 101 of the two installation arms 11 and 12 are respectively locked by the first locking member 31, and then as shown in FIG. 21G, the second end portions 102 of the two installation arms 11 and 12 are released from the second locking member 32, so that the plurality of shoe covers can be ready for dispensing from the second end portions 102 of the two installation arms 11 and 12, as shown in FIG. 21H.

Figure 22A:
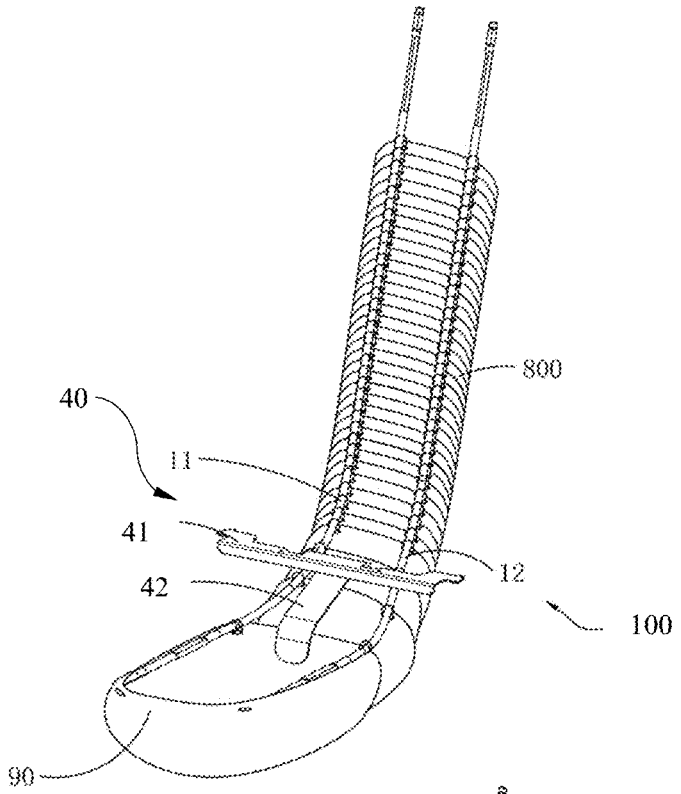
FIGS. 22A to 22B are perspective views illustrating a retaining element of the shoe cover dispenser device according to the preferred embodiment of the present invention.
Figure 22B:
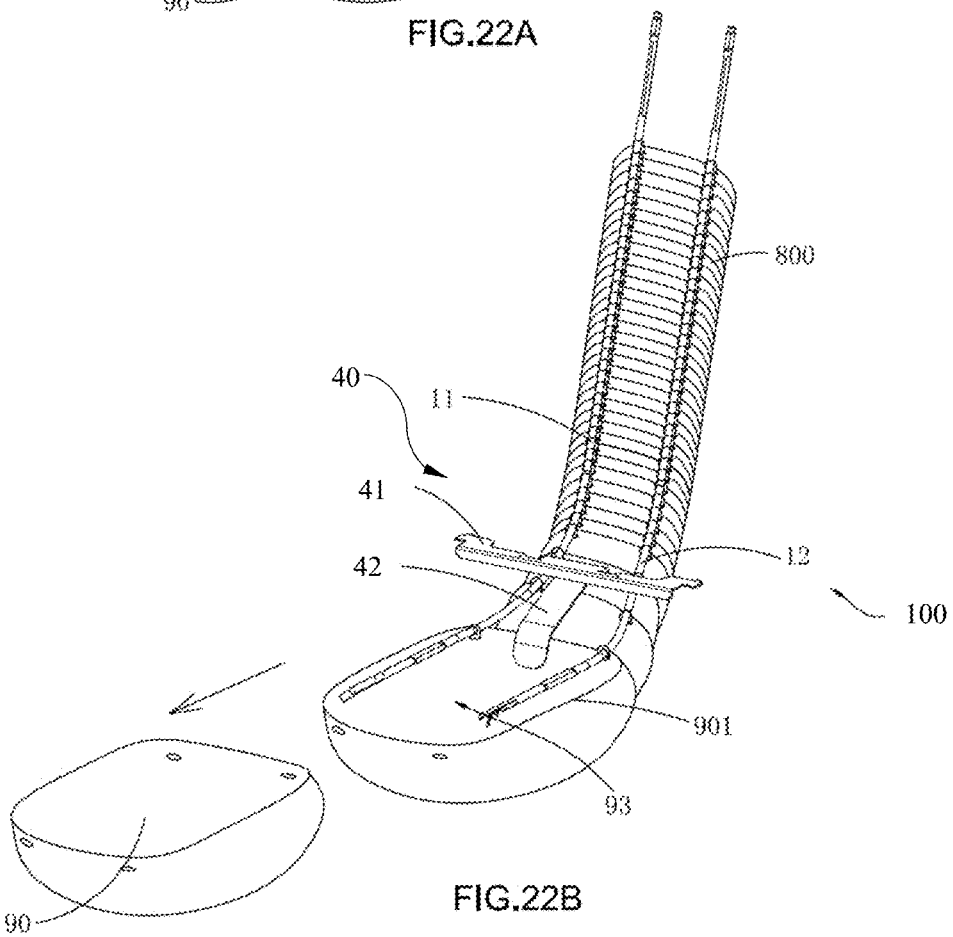

As shown in FIGS. 22A to 22B which illustrate a retention element 40 of the shoe cover dispenser device 100 of the present invention. More specifically, the retention element 40 comprise a mounting frame 41 and a retention member 42 which can be a retention piece. The mounting frame 41 is connected to the frame 20, the retention member 42 is fixedly connected to the mounting frame 41 and is located between the two installation arms 11 and 12.

Specifically, the retention member 42 is implemented as an elastic material sheet with an arc-shaped structure, and the retention member 42 provide a one-way damping function, so as to prevent the retention member 42 from being affected by the inertial force of the shoe covers 90. As the shoe covers 90 are driven to move, and the retention member 42 can realize the effect of enlarge the openings 93 of the shoe covers 90 through the deformation and rebound of the elastic material sheet.

As a modification of this alternative mode of the present invention, the retention member 42 may also be a metal sheet with other structural shapes, and a torsion spring or tension spring may be provided to generate damping functions, so as to facilitate to keep the standby shoe cover 90 having the enlarged opening 93.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A shoe cover dispenser device for dispensing a plurality of shoe covers, comprising:

a frame;

an installation assembly installed on said frame, wherein said installation assembly comprises two installation arms for installing the plurality of shoe covers, wherein each of the said installation arms has a first end portion and a second end portion; and a locking assembly, installed on the frame and locking said two installation arms of said installation assembly, comprising:

a first locking member, which is arranged at said first end portion of each of said two installation arms, comprising two holding members each having a slot for receiving said first end portion of each of said two installation arms, a locking element that is movable for locking said first end portion of each of said two installation arms in said slot, and two self-locking assemblies each comprising a self-locking body having a receiving groove, a self-locking member movably arranged at said receiving groove for blocking said first end portions of said two installation arms from moving out of said receiving grooves, and a reset member disposed to said self-locking member, wherein said reset member is operated to allow said self-locking member to rotate away from said receiving groove, so as to allow said first end portions of said two installation arms to escape from said receiving groove, and a second locking member arranged to detachably lock said second end portion of each of the two installation arms.

2. A shoe cover dispenser device for dispensing a plurality of shoe covers, comprising:

a frame;

an installation assembly installed on said frame, wherein said installation assembly comprises two installation arms for installing the plurality of shoe covers, wherein each of the said installation arms has a first end portion and a second end portion; and a locking assembly, installed on the frame and locking said two installation arms of said installation assembly, comprising:

a first locking member which is arranged at said first end portion of each of said two installation arms and comprises two holding members each having a slot for receiving said first end portion of each of said two installation arms, and a locking element that is movable for locking said first end portion of each of said two installation arms in said slot, wherein said first locking member comprises two locking sleeves each of which has an engaging groove for receiving said first end portion of each of said two installation arms and a mounting hole, and comprises an elastic lock that is elastically provided in said mounting hole for being pushed up or down to lock or release said first end portion of each of said two installation arms, and a second locking member arranged to detachably lock said second end portion of each of the two installation arms.

3. A shoe cover dispenser device for dispensing a plurality of shoe covers, comprising:

a frame;

an installation assembly installed on said frame, wherein said installation assembly comprises two installation arms for installing the plurality of shoe covers, wherein each of the said installation arms has a first end portion and a second end portion;

a locking assembly, installed on the frame and locking said two installation arms of said installation assembly, comprising:

a first locking member which is arranged at said first end portion of each of said two installation arms and comprises two holding members each having a slot for receiving said first end portion of each of said two installation arms, and a locking element that is movable for locking said first end portion of each of said two installation arms in said slot, and a second locking member arranged to detachably lock said second end portion of each of the two installation arms; and two stoppers, each comprising a plurality of stopper claws, respectively mounted on said two installation arms to prevent a subsequent shoe cover to retract when a standby shoe cover has been dispensed from said two installation arms.

4. A shoe cover dispenser device for dispensing a plurality of shoe covers, comprising:

a frame;

an installation assembly installed on said frame, wherein said installation assembly comprises two installation arms for installing the plurality of shoe covers, wherein each of the said installation arms has a first end portion and a second end portion;

a locking assembly, installed on the frame and locking said two installation arms of said installation assembly, comprising:

a first locking member which is arranged at said first end portion of each of said two installation arms and comprises two holding members each having a slot for receiving said first end portion of each of said two installation arms, and a locking element that is movable for locking said first end portion of each of said two installation arms in said slot, and a second locking member arranged to detachably lock said second end portion of each of the two installation arms; and two stoppers respectively mounted on said two installation arms to prevent a subsequent shoe cover to retract when a standby shoe cover has been dispensed from said two installation arms, wherein each of said two stoppers comprises a first stopper end portion and a second stopper end portion, wherein each of said first stopper end portion and said second stopper end portion is extended inwardly and is formed in an arc shape, wherein said first stopper end portion and second stopper end portion are spaced apart from each other and have different lengths.

5. A shoe cover dispenser device for dispensing a plurality of shoe covers, comprising:

a frame;

an installation assembly installed on said frame, wherein said installation assembly comprises two installation arms for installing the plurality of shoe covers, wherein each of the said installation arms has a first end portion and a second end portion; and a locking assembly, installed on the frame and locking said two installation arms of said installation assembly, comprising:

a first locking member which is arranged at said first end portion of each of said two installation arms and comprises two holding members each having a slot for receiving said first end portion of each of said two installation arms, and a locking element that is movable for locking said first end portion of each of said two installation arms in said slot, and a second locking member arranged to detachably lock said second end portion of each of the two installation arms, wherein said first locking member and said second locking member form a single integral piece, wherein when said second locking member releases said second end portions of said two installation arms, said second locking member simultaneously locks said second end portions of said two installation arms, wherein when said second locking member releases said first end portions of said two installation arms, said first locking member simultaneously locks said second end portions of said two installation arms.

6. The shoe cover dispenser device, as recited in claim 5, wherein said first locking member comprises a transmission mechanism, a guiding mechanism coupled to said transmission mechanism, a locking unit for locking said first end portion of each of said two installation arms, wherein said guiding mechanism is driven by said transmission mechanism to move to push said first end portion of each of said two installation arms, so as to retain said first end portion of each of said two installation arms in said locking unit.

7. The shoe cover dispenser device, as recited in claim 6, wherein said locking unit comprises two holding members each has a slot for receiving said first end portion of each of said two installation arms, and a locking ball that is movable for locking said first end portion of each of said two installation arms in said slot.

8. The shoe cover dispenser device, as recited in claim 6, wherein said guiding mechanism comprises a displacement mechanism having a displacement groove, a sliding member movable in said displacement hole of said displacement mechanism that is coupled with said transmission mechanism for being driven to displace, a control mechanism that is capable of being driven by said sliding member to push said first end portion of each of said two installation arms.

9. The shoe cover dispenser device, as recited in claim 8, wherein said control mechanism comprises a guide rod, a pusher member and a pivot shaft mounted to said frame, wherein said guide rod is pivotally mounted to said pivot shaft, wherein said pusher member is extended from said guide rod for pushing said first end portion of each of said two installation arms.

10. The shoe cover dispenser device, as recited in claim 8, wherein said transmission mechanism comprises at least one crank, and an actuating mechanism comprising one or more connecting rods that are driven by said at least one crank to move when said at least one crank is operated to rotate.

11. The shoe cover dispenser device, as recited in claim 10, wherein said second locking member is integrated with said at least one crank to form a cover frame.

12. The shoe cover dispenser device, as recited in claim 5, wherein said guiding mechanism comprises a displacement mechanism has a retaining surface defining said displacement groove, wherein said retaining surface comprises a retention surface which is a curved surface and a straight surface extended from retention surface.

* * * * *